United States Patent [19]

Kojima et al.

[11] Patent Number: 4,948,711

[45] Date of Patent: Aug. 14, 1990

[54] METHOD FOR PROCESSING SILVER HALIDE PHOTOGRAPHIC LIGHT-SENSITIVE MATERIALS

[75] Inventors: Tetsuro Kojima; Yoshihiro Fujita; Junichi Yamanouchi; Tomokazu Yasuda, all of Minami-Ashigara, Japan

[73] Assignee: Fuji Photo Film Co., Ltd., Kanagawa, Japan

[21] Appl. No.: 315,562

[22] Filed: Feb. 27, 1989

[30] Foreign Application Priority Data

Feb. 29, 1988 [JP] Japan ..... 63-47269

[51] Int. Cl.[5] ..... G03C 7/00; G03C 7/02

[52] U.S. Cl. ..... 430/393; 430/400; 430/430; 430/455

[58] Field of Search ..... 430/393, 400, 455, 430, 430/518, 941

[56] References Cited

U.S. PATENT DOCUMENTS

| | | | |
|---|---|---|---|
| 3,958,995 | 5/1976 | Campbell et al. | 430/518 |
| 4,311,799 | 1/1982 | Miyake et al. | 521/31 |
| 4,312,940 | 1/1982 | Nakamura et al. | 430/510 |
| 4,353,972 | 10/1982 | Helling et al. | 430/213 |
| 4,480,025 | 10/1984 | Chang et al. | 430/206 |
| 4,533,621 | 8/1985 | Ikeuchi et al. | 430/213 |
| 4,605,611 | 8/1986 | Ohno et al. | 430/400 |
| 4,721,666 | 1/1988 | Yamanouchi et al. | 430/213 |
| 4,775,612 | 10/1988 | Abe et al. | 430/393 |

FOREIGN PATENT DOCUMENTS

| | | | |
|---|---|---|---|
| 629346 | 1/1987 | Japan . | |
| 2158258 | 11/1985 | United Kingdom | 430/400 |

*Primary Examiner*—Paul R. Michl
*Assistant Examiner*—Patrick A. Doody
*Attorney, Agent, or Firm*—Burns, Doane, Swecker & Mathis

[57] ABSTRACT

A method for continuously processing silver halide color photographic light-sensitive materials comprises the steps of developing an exposed silver halide color photogrpahic light-sensitive material which comprises at least one emulsion layer formed from a silver halide emulsion containing not less than one mole % of silver iodide, then desilvering the developed light-sensitive material with a solution having a fixing ability, washing and/or stabilizing the desilvered light-sensitive material, the processing solution having fixing ability comprising at least one member selected from the group consisting of polymer dispersions containing polymer such as polymer (1) and water-soluble polymers such as polymer (30).

(1)

x:z = 10:90

(30)

y:z = 30:70

16 Claims, No Drawings

METHOD FOR PROCESSING SILVER HALIDE PHOTOGRAPHIC LIGHT-SENSITIVE MATERIALS

BACKGROUND OF THE INVENTION

The present invention relates to a method for processing a silver halide photographic light-sensitive material and more particularly to a method for processing silver halide photographic light-sensitive materials which makes it possible to speed up desilvering treatment of the silver halide photographic light-sensitive materials as well as to reduce the amount of waste liquor.

Generally, essential steps which are involved in the processing of color light-sensitive materials are color developing and desilvering processes. In the color developing process, the silver halide exposed to light is reduced with a developing agent to form elemental silver, on the other hand, the oxidized develping agent causes a reaction with a dye forming agent (coupler) to provide dye images. In the subsequent desilvering process, the elemental silver formed during the color developing process is oxidized with an oxidizing agent (generally referred to as "bleaching agent") and then the oxidized silver is made soluble in the developer by the action of a chelating agent for silver (usually referred to as "fixing agent"). Only the dye images remain on the color light-sensitive material through such a desilvering process.

The desilvering process can be performed using two baths, i.e., a bleaching bath containing a bleaching agent and a fixing bath containing a fixing agent or only one bath, i.e., bleach-fixing bath containing both bleaching and fixing agents.

The practical development further comprises, in addition to the foregoing processes, a variety of auxiliary processes for various purposes of, for instance, maintaining photographic and physical qualities of images and improving storability of images. Specific examples of such auxiliary processes (or baths) are a film-hardening bath, a stopping bath, a bath for stabilizing images and water washing baths.

Recently, a small-sized processing system called "Minilabo" is developed and the color light-sensitive materials are now processed in a photograph shop. It has been desired correspondingly to develop a rapid processing method for achieving short-time finishing and to reduce the amount of waste liquor of processing solutions or the amount of the processing solutions to be supplemented from the viewpoint of workability and processing cost. In the desilvering process, it is likewise tried to reduce the amount of the processing solutions to be supplemented (or replenishers). However, if the amount of the replenishers for the bleach-fixing and fixing solutions is reduced, a large amount of substances dissolved out from the light-sensitive materials, during desilvering process, such as silver ions and iodide ions are accumulated in the processing solution and as a result the rate of desilvering process extremely lowers. Particularly, the presence of iodide ions greatly impairs the desilvering rate. This problem becomes remarkable in the processing of light-sensitive materials for taking photographs containing a large amount of silver and iodide ions. However, such a reduction in desilvering rate is not acceptable since it is quite incompatible with the object of rapid processing. It has correspondingly been desired to develop a method for processing in which the reduction in the amount of the replenisher and the rapid processing can simultaneously be achieved and various studies have been conducted.

For instance, a method for regenerating a bleach-fixing solution by recovering silver therefrom to reuse the same is disclosed in Japanese Patent Un-examined Publication (hereinafter referred to as "J.P. KOKAI") Nos. 50-98837, 51-18541, 51-19535, 51-23732 and 54-19496 and Japanese Patent Publication for Opposition Purpose (hereunder referred to as "J.P. KOKOKU") No. 58-22528.

In addition, as to the recovery of silver from a fixing solution, J.P. KOKAI Nos. 62-69264, 62-71952 and 62-75525 propose that the reduction in the amount of replenisher (or waste liquor) and the rapid processing can be similtaneously achieved by fixing light-sensitive materials while simultaneously recovering silver and then bleach-fixing the material.

The foregoing methods are successful in some degree in the processing of light-sensitive materials having a low silver content, but they are not necessarily satisfied in the processing of light-sensitive materials having a high silver content and including iodide ions.

Moreover, OLS Nos. 2,717,674 and 2,916836; U.S. Pat. No. 3,253,920 and J.P. KOKAI Nos. 52-105820, 57-146249 and 61-95352 disclose a method for removing halogen ions by recovering a developer with an ion-exchange resin or an ion-exchange film, but this method is not necessarily successful in the removal of iodide ions from a fixing or bleach-fixing solution which contains a variety of anionic components other than iodide ions.

SUMMARY OF THE INVENTION

Accordingly, an object of the present invention is to provide an improved method for processing silver halide color photographic light-sensitive materials.

Another object of the present invention is to provide a method for processing silver halide color photographic light-sensitive materials which makes it possible to effectively and selectively remove iodide ions from a processing solution.

A further object of the present invention is to provide a method for processing silver halide coior photographic light-sensitive materials which can simultaneously achieve rapid processing and the reduction in the amount of replenisher or waste liquor.

The inventors of the present invention have conducted various studies to eliminate the foregoing drawbacks associated with the conventional methods for processing light-sensitive materials and have found that iodide ions present in a processing solution can selectively and rapidly be removed by adding a specific polymer dispersion or a specific water-soluble polymer to a fixing or bleach-fixing solution when compared with ion-exchange resins or the like used in the conventional methods.

Thus, the aforementioned objects of the present invention can effectively be attained by providing a method for continuously processing silver halide color photographic light-sensitive materials which comprises the steps of developing an exposed silver halide color photographic light-sensitive material, then desilvering the developed material with a solution having fixing ability, washing and/or stabilizing the desilvered material, the light-sensitive material being provided thereon with at least one emulsion layer which is formed from a silver halide emulsion containing not less than one mole% of silver iodide and the processing solution having fixing ability comprising at least one member selected from the group consisting of dispersions of polymers or water-soluble polymers represented by the following general formula (I):

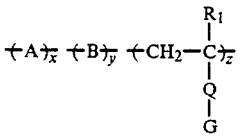

(I)

In the formula (I), A represents a copolymerizable monomer unit having at least two copolymerizable ethylenically unsaturated groups, at least one of which is attached to the side chain of the monomer; B represents a copolymerizable ethylenically unsaturated monomer unit other than the monomer unit of A and the monomer unit having the copolymerization ratio of Z; $R_1$ is a hydrogen atom, a lower alkyl group or an aralkyl group; Q is a single bond, an alkylene group, a phenylene group, an aralkylene group, —CO—O—L—, —CO—NH—L— or —CO—NR—L— (wherein L represents an alkylene, arylene or aralkylene group and R represents an alkyl group); G represents a group represented by the following general formula (a) or (b):

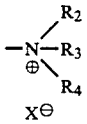

(a)

or

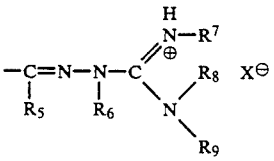

(b)

(in the formulas (a) and (b), $R_3$ to $R_9$ may be the same or different and each represents a hydrogen atom, an alkyl group, an aryl group or an aralkyl group, which may be substituted; $X^-$ is an anion, provided that at least two of Q, $R_2$, $R_3$ and $R_4$, or at least two of Q and $R_5$ to $R_9$ may be bonded together to form a ring structure together with the nitrogen atom(s)); and x, y and z represent molar percentages of the corresponding repeating units respectively. In this connection, x is in the range of 0 to 60, y is in the range of 0 to 60 and Z is in the range of 30 to 100.

The term "continuous processing" herein means continuous or discontinuous processings over a long time while supplementing processing solutions. The amount of the processing solutions to be supplemented (replenishers) is determined depending on, for instance, area of the light-sensitive material to be processed and the processing time.

In general, the supplementation of a fixing or bleach-fixing solution is performed depending on the area of the light-sensitive material processed, but if the amount of the replenisher is reduced, the desilvering rate lowers because of the accumulation of substances dissolved out from the light-sensitive materials during processing and therefore, the desilvering becomes insufficient during a certain period of the processing time.

However, if the compounds specific to the present invention as defined above are used, the delay in desilvering can be prevented and a rapid desilvering process can be attained together with reduction in the amount of the replenisher.

In addition, since the present invention does not use polymer particles which are water-insoluble and incompatible with water, such as the conventional ion-exchange resins, but uses a specific polymer dispersion and/or water-soluble polymer defined by formula I, there can be obtained good advantages in case of processing photographic materials, i.e., the photographic material having no damage such as scratch by adding the dispersion or the water-soluble polymer directly to the solution having a fixing ability.

The polymer dispersion usable in the present invention is an aqueous dispersion in which a water-insoluble polymer defined by the formula I is stably dispersed in water, which has a number-average molecular weight of 100,000 to 2,000,000, preferably 200,000 to 1,000,000, and particle size of which is preferably not more than 10μ, more preferably not more than 5μ, most preferably not more than 0.5μ.

Any surfactant can be used so as to disperse the polymer particles in water and typical example of the dispersion includes a latex. As a rule, the dispersion is prepared by using a water-soluble polymerization initiator and conducting the polymerization reaction in the presence of emulsion stabilizing agent such as a surfactant. In this regards, since the water-soluble polymerization initiator is used, the polymerization initiating reaction occurs in the water phase and the polymerization reaction proceeds in the micelle formed by the effect of the surfactant, so that the particle of the polymer thus prepared becomes extremely small, i.e., not more than 0.5μ.

On the other hand, the water-soluble polymers defined by formula I generally have a number-average molecular weight of 5,000 to 1,000,000, preferably 10,000 to 500,000.

The compounds represented by the general formula (I) will hereunder be explained in more detail. The monomer unit A is a multifunctional monomer unit which can crosslink units A each other. Examples of the monomer units A include divinyl benzene, ethylene glycol dimethacrylate, diethylene glycol dimethacrylate, triethylene glycol dimethacrylate, ethylene glycol diacrylate, diethylene glycol diacrylate, 1,6-hexanediol diacrylate, neopentyl glycol dimethacrylate, and tetramethylene glycol dimethacrylate. Among these, particularly preferred are divinyl benzene and ethylene glycol dimethacrylate. The unit A may comprise at least two monomers listed above.

Examples of the monomer units B include ethylenically unsaturated monomers such as ethylene, propylene, 1-butene, isobutene, styrene, α-methyl styrene, vinyl toluene, mono-ethylenically unsaturated esters of aliphatic acids (for instance, vinyl acetate and allyl acetate), esters of ethylenically unsaturated mono- or dicarboxylic acids (for instance, methyl methacrylate, ethyl methacrylate, n-butyl methacrylate, n-hexyl methacrylate, cyclohexyl methacrylate, benzyl methacrylate, n-butyl acrylate, n-hexyl acrylate, and 2-ethylhexyl acrylate), monlethylenically unsaturated compounds, for instance, acrylonitrile, or dienes (for instance, butadiene and isoprene). Among these, particularly preferred are styrene, n-butyl methacrylate and cyclohexyl methacrylate. B may comprise at least two such monomer units.

$R_1$ is preferably a hydrogen atom, a lower alkyl group having 1 to 6 carbon atoms such as methyl, ethyl, n-propyl, n-butyl, n-amyl and n-hexyl, or an aralkyl group such as benzyl group. Particularly preferred are a hydrogen atom or a methyl group.

Q is preferably an optionally substituted divalent alkylene group having 1 to 12 carbon atoms such as a methylene or a group: $—(CH_2)_6—$, an optionally substituted phenylene group or an optionally substituted aralkylene group having 7 to 12 carbon atoms such as a group: $—Phe—CH_2—$ or $—Phe—CH_2—CH_2—$ (wherein Phe represents a phenylene nucleus). In addition, —CO—O—L—, —CO—NH—L— or —CO—N-R—L— is also preferred. Wherein L is preferably an optionally substituted alkylene group having 1 to 6 carbon atoms, an optionally substituted arylene group or an optionally substituted aralkylene group having 7 to 12 carbon atoms and more preferably an optionally substituted alkylene group having 1 to 6 carbon atoms. R is preferably an alkyl group having 1 to 6 carbon atoms.

G represents a group (a) or (b). In the formulas (a) and (b), $R_2$ to $R_9$ may be the same or different and each is preferably a hydrogen atom, a substituted or unsubstituted alkyl group having 1 to 20 carbon atoms, a substituted or unsubstituted aryl group having 6 to 20 carbon atoms, or a substituted or unsubstituted aralkyl group having 7 to 20 carbon atoms.

Examples of alkyl groups include unsubstituted alkyl groups such as methyl, ethyl, n-propyl, isopropyl, n-butyl, isobutyl, t-butyl, n-amyl, isoamyl, n-hexyl, cyclohexyl, n-heptyl, n-octyl, 2-ethylhexyl, n-nonyl, n-decyl and n-dodecyl groups. Preferred number of carbon atoms of the alkyl groups range from 1 to 12, more preferably 4 to 10.

Examples of substituted alkyl group include an alkoxyalkyl group such as methoxymethyl, methoxyethyl, methoxybutyl, ethoxyethyl, ethoxypropyl, ethoxybutyl, butoxyethyl, butoxypropyl, butoxybutyl or vinyloxyethyl group; a cyanoalkyl group such as 2-cyanoethyl, 3-cyanopropyl or 4-cyanobutyl group; a halogenated alkyl group such as 2-fluoroethyl, 2-chloroethyl or 3-fluoropropyl group; an alkoxycarbonylalkyl group such as ethoxycarbonylmethyl group; an allyl group, 1-butenyl group and propargyl group.

Examples of aryl groups include an unsubstituted aryl group such as a phenyl or naphthyl group; and a substituted aryl group such as an alkyl aryl group (e.g., 2-methylphenyl, 3-methylphenyl, 4-methylphenyl, 4-isopropylphenyl or 4-tert-butylphenyl group), an alkoxyaryl group (e.g., 4-methoxyphenyl, 3-methoxyphenyl or 4-ethoxyphenyl group) and an aryloxyaryl group (e.g., 4-phenoxyphenyl group). The aryl group preferably has 6 to 14 carbon atoms, more preferably 6 to 10 carbon atoms. Particularly preferred is a phenyl group.

Examples of aralkyl groups include an unsubstituted aralkyl group such as a benzyl, phenethyl, diphenylmethyl or naphthlmethyl group; a substituted aralkyl group such as an alkylaralkyl group (e.g., 4-methylbenzyl, 2,5-dimethylbenzyl or 4-isopropylbenzyl group), an alkoxyaralkyl group (e.g., 4-methoxybenzyl or 4-ethoxybenzyl group), a cyanoaralkyl group (e.g., 4-cyanobenzyl group), a perfluoroalkoxyaralkyl group (e.g., 4-pentafluoropropoxybenzyl or 4-undecafluorohexyloxybenzyl group) and a halogenated aralkyl group (e.g., 4-chlorobenzyl, 4-bromobenzyl or 3-chlorobenzyl group). The aralkyl group preferably has 7 to 15 carbon atoms, more preferably 7 to 11 carbon atoms. Particularly preferred are a benzyl group or a phenethyl group.

$R_2$ to $R_4$ each preferably represents an alkyl or aralkyl group and in particular an alkyl group.

$R_5$ to $R_9$ each preferably represents a hydrogen atom or an alkyl group.

$X^-$ represents an anion and examples thereof are a halogen ion such as a chloride or bromide ion; an alkyl- or aryl-sulfonic acid ion such as a methane sulfonic acid, ethane sulfonic acid, benzene sulfonic acid or p-toluene sulfonic acid ion; an acetate ion, a sulfate ion and a nitrate ion. Particularly preferred are a chloride, acetate or sulfate ion.

It is also preferred that at least two of Q and $R_2$ to $R_4$ be bonded to one another to form a ring structure together with the nitrogen atom(s). Preferred examples of such ring structures formed are a pyrrolidine, piperidine, morpholin, pyridine, imidazole and quinuclidine rings. Particularly preferred are pyrrolidine, morpholine, piperidine, imidazole and pyridine rings.

At least two of Q and $R_5$ to $R_9$ may be bonded to one another to form a ring structure together with the nitrogen atom(s) and particularly preferred rings are 6- and 5-membered rings.

The polymers used in the present invention may comprise at least two monomer units: $—CH_2—C(R_1)(Q-G)—$ listed above.

x ranges from 0 to 60 mole%, preferably 0 to 40 mole%, more preferably 0 to 30 mole%, y ranges from 0 to 60 mole%, preferably 0 to 40 mole%, more preferably 0 to 30 mole%; and z ranges from 30 to 100 mole%, preferably 40 to 95 mole%, more preferably 50 to 85 mole%.

Among the compounds represented by the general formula (I), particularly preferred are those represented by the following general formula (II):

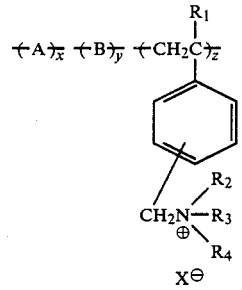

(II)

In the general formula (II), A, B, x, y, z, $R_1$ to $R_4$ and $X^-$ are the same as those defined above in connection with the general formula (I).

Preferred compounds (II) are those represented by formula (II) in which $R_2$, $R_3$ and $R_4$ each represents an alkyl group and the total number of carbon atoms of $R_2$, $R_3$ and $R_4$ are not less than 12.

Examples of the polymers represented by the general formula (I) used in the present invention are as follows, but the present invention is not restricted to these specific examples.

(1)
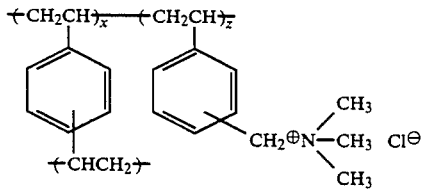
x:z = 10:90
(2)
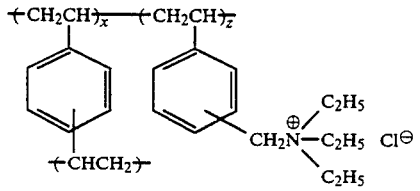
x:z = 25:75
(3)
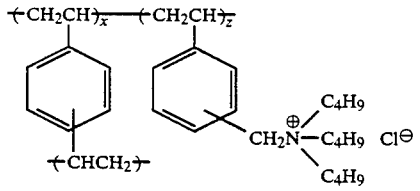
x:z = 31:69
(4)
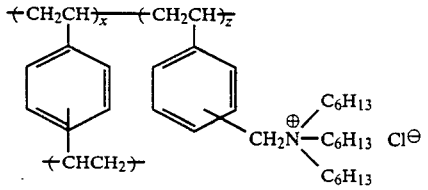
x:z = 33:67
(5)
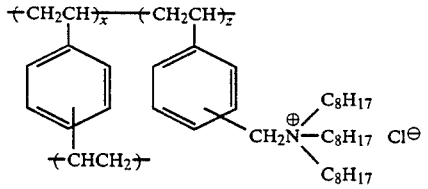
x:z = 30:70
(6)
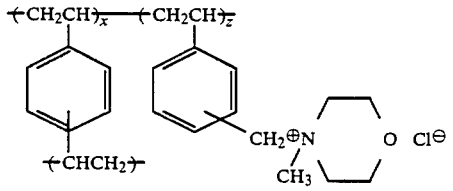
x:z = 10:90

-continued
(7)
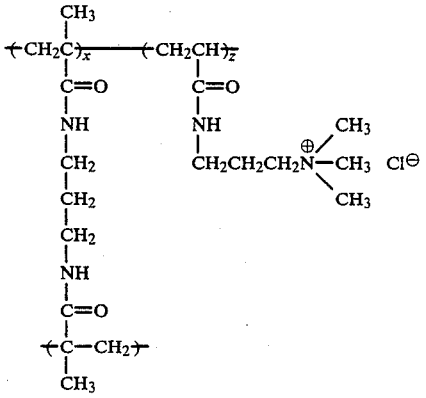
x:z = 20:80
(8)
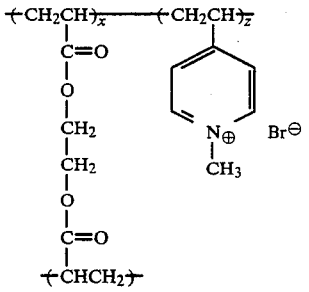
x:z = 20:80
(9)
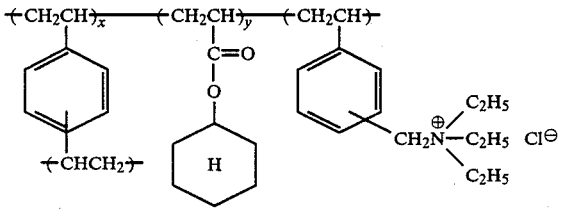
x:y:z = 20:20:60
(10)
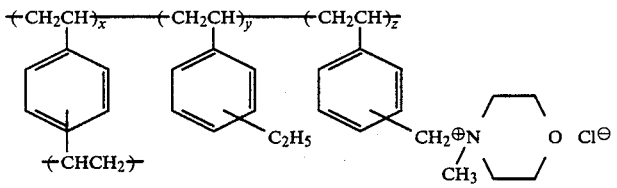
x:y:z: = 5:47:48
(11)
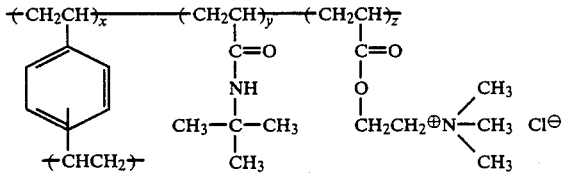
x:y:z = 10:40:50

-continued
(12)
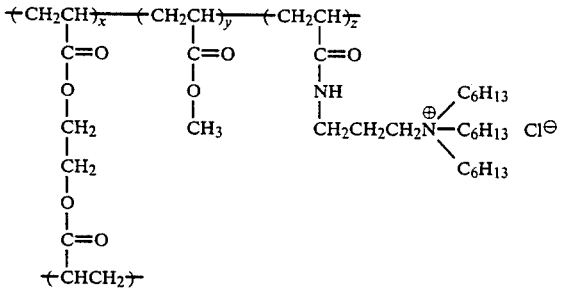
x:y:z = 10:10:80
(13)
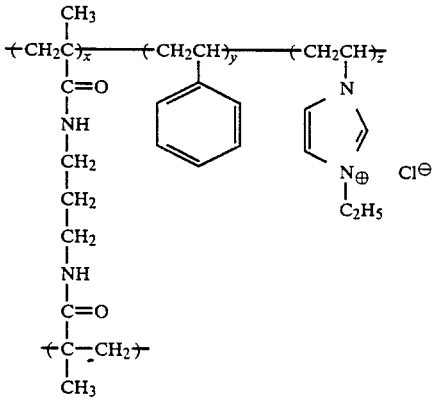
x:y:z = 5:25:70
(14)
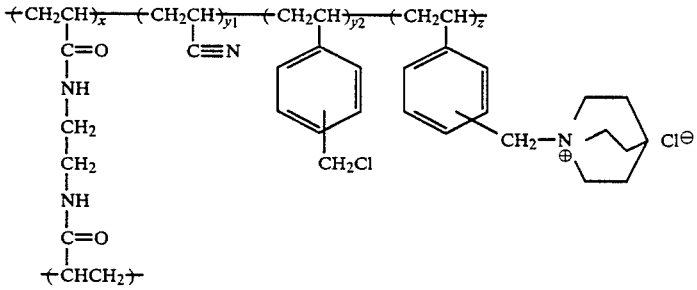
x:$y_1$:$y_2$:z = 10:10:7:73
(15)
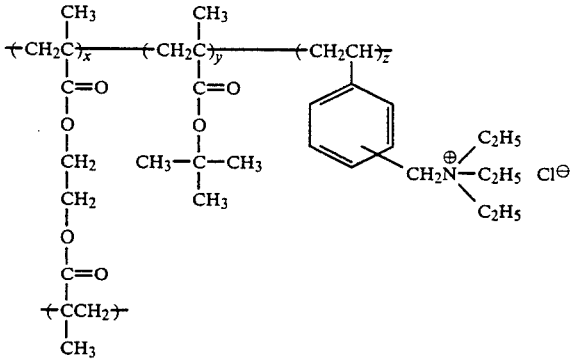
x:y:z = 30:35:35
(16)
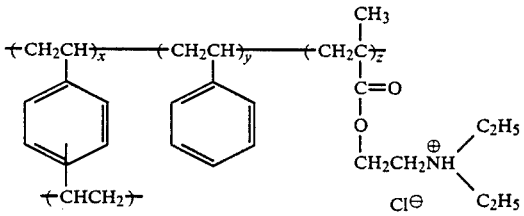
x:y:z = 15:5:80

-continued
(17)
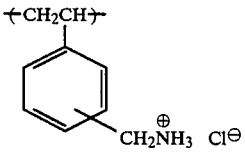
(18)
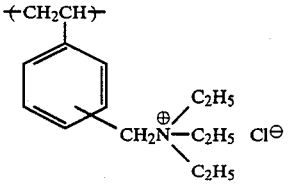
(19)
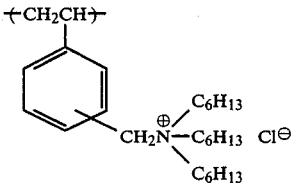
(20)
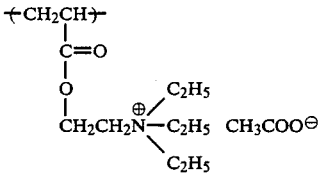
(21)
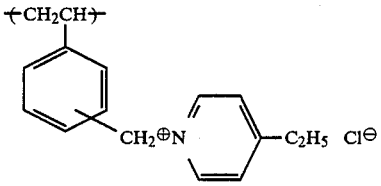
(22)
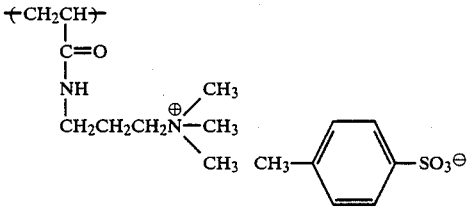
(23)
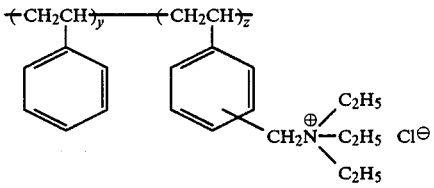
y:z = 45:55
(24)
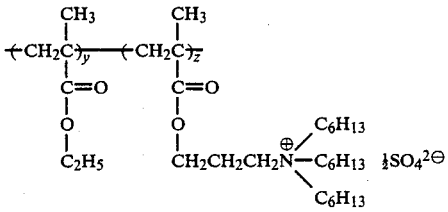
y:z = 40:60

-continued
(25)
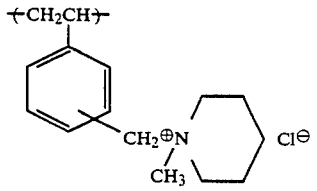
(26)
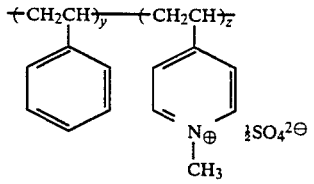
y:z = 25:75
(27)
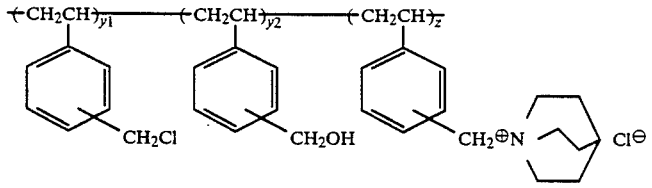
$y_1:y_2:z$ = 10:5:85
(28)
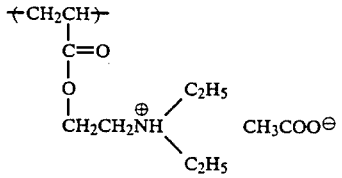
(29)
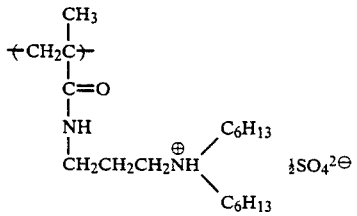
(30)
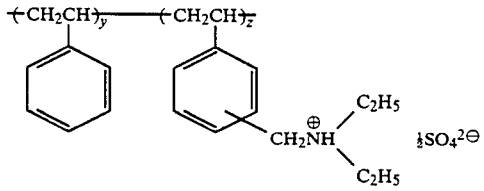
y:z = 30:70
(31)
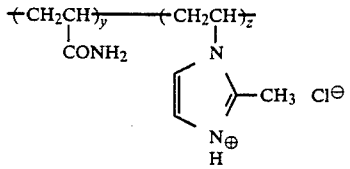
y:z = 50:50
(32)
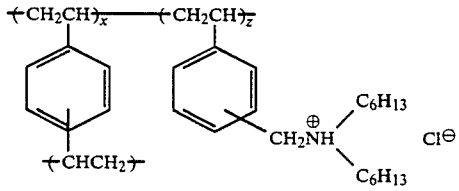

-continued
x:z = 10:90
(33)
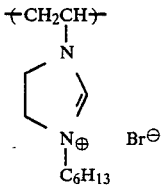
(34)
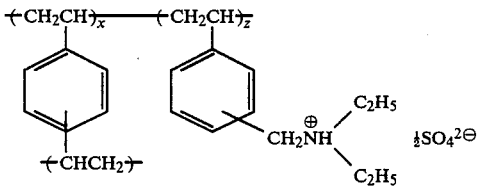
x:z = 20:80
(35)
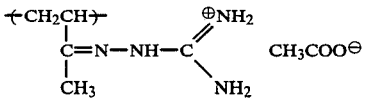
(36)
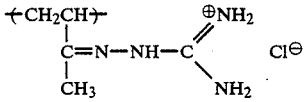
(37)
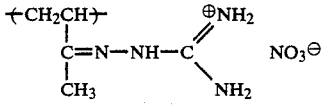
(38)
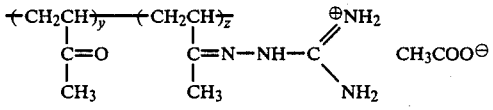
y:z = 40:60
(39)
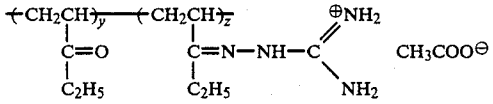
y:z = 20:80
(40)
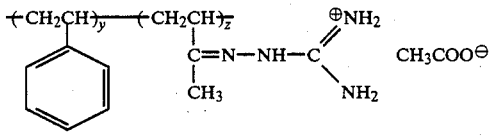
y:z = 50:50
(41)
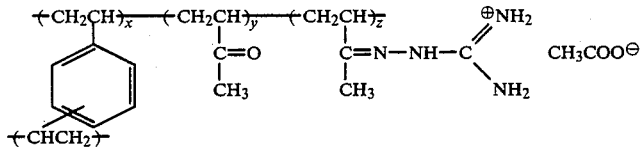
x:y:z = 15:25:60
(42)
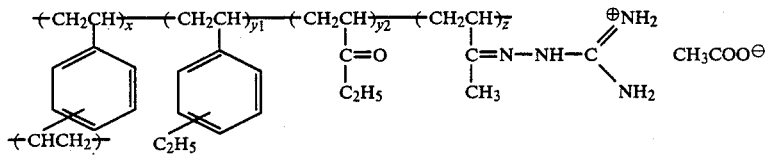
x:$y_1$:$y_2$:z = 20:5:25:50

-continued (43)

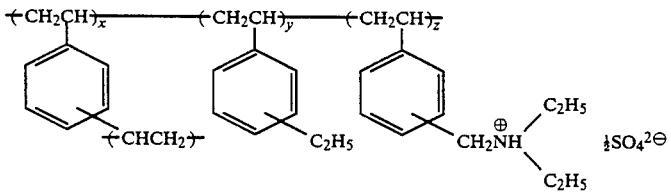

x:y:z = 11:9:80

Among these polymers, preferred water-soluble ones are (17) to (31), (33) and (35) to (40).

The method for preparing the compounds represented by the general formula (I) in which G is a group (a) will hereunder be explained.

The compounds of formula (I), in which G is a group (a), can in general be prepared by polymerizing a copolymerizable monomer having at least two ethylenically unsaturated groups, an ethylenically unsaturated monomer and a monomer represented by the following general formula (c):

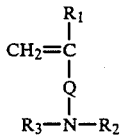

(c)

(wherein $R_1$ to $R_3$, and Q are the same as those defined above) such as N,N-dimethylaminoethyl methacrylate, N,N-diethylaminoethyl methacrylate, N,N-dimethylaminoethyl acrylate, N,N-diethylaminoethyl acrylate, N-(N,N-dimethylaminopropyl)-acrylamide, N-(N,N-dihexylaminomethyl)-acrylamide, 3-(4-pyridyl)-propyl acrylate, N,N-diethylaminomethyl styrene, N,N-dihexylaminomethyl styrene, 2-vinylpyridine or 4-vinylpyridine, preferably N,N-diethylaminoethyl methacrylate, N,N-diethylaminoethyl styrene or N,N-dihexylaminomethyl styrene; and then converting the polymerized product to an ammonium salt with a compound represented by the formula: $R_4$—X (wherein $R_4$ and X are the same as those defined above) such as hydrochloric acid, nitric acid, sulfuric acid, p-toluene sulfonic acid, acetic acid, ethyl bromide, hexyl bromide or benzyl chloride.

Alternatively, the polymers represented by the general formula (I), in which G is a group (a), used in the present invention can likewise be prepared by polymerizing a copolymerizable monomer having at least two ethylenically unsaturated groups such as those listed above, an ethylenically unsaturated monomer and an unsaturated monomer represented by the following general formula (d):

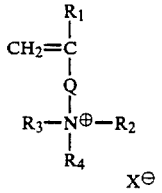

(wherein $R_1$ to $R_4$, X and Q are the same as those defined above) such as N,N-dimethylaminoethyl methacrylate hydrochloride, N,N-diethylaminoethyl methacrylate sulfate, N,N-dimethylaminoethyl acrylate hydrochloride, N,N-diethylaminoethyl acrylate acetate, N-(N,N,N-trimethylammoniopropyl) acrylamide chloride, N-(N,N,N-trihexylammoniomethyl) acrylamide chloride, 3-(4-N-methylpyridyl)-propyl acrylate p-toluene sulfonate, N,N-diethylaminomethyl styrene sulfate, 2-vinylpyridine hydrochloride, N,N,N-trihexylammoniomethyl styrene chloride, N,N,N-trioctylammoniomethyl styrene chloride, N,N,N-tributylammoniomethyl styrene chloride, N-benzyl-N,N-dimethylammoniomethyl styrene chloride or 4-vinylpyridine hydrochloride, preferably N,N,N-trihexylammoniomethyl styrene chloride or N,N,N-trioctylammoniomethyl styrene chloride.

In addition, the polymers represented by the general formula (I), in which G is a group (a), used in the present invention can likewise be prepared by polymerizing a copolymerizable monomer having at least two ethylenically unsaturated groups such as those listed above, an ethylenically unsaturated monomer and an unsaturated monomer represented by the following general formula (e):

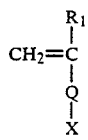

(wherein X represents a halogen atom such as a chlorine or bromine atom, or a sulfonic acid ester residue such as a p-toluenesulfonyloxy group; and $R_1$ and Q are the same as those defined above) such as β-chloroethyl methacrylate, β-p-toluenesulfonyloxyethyl methacrylate or chloromethyl styrene; and then converting the polymerized product to an ammonium salt with an amine represented by the formula: $R_2$—N($R_4$)—$R_3$ (wherein $R_2$ to $R_4$ are the same as those defined above) such as dimethylamine, diethylamine, diisopropylamine, morpholine, piperidine, pyridine, trimethylamine, N-methylmorpholine, tributylamine, trihexylamine, trioctylamine or triethylamine.

Among the compounds represented by the general formula (I), those of formula (I) in which G is a group represented by formula (b) can be prepared as follows:

The polymers represented by formula (I), in which G is a group (b), used in the present invention can be obtained by polymerizing a polymerizable monomer having at least two ethylenically unsaturated groups such as those explained above, an ethylenically unsaturated monomer and an unsaturated monomer represented by the following general formula (f):

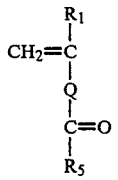

(f)

(wherein $R_1$, $R_5$ and Q are the same as those defined above) such as methyl vinyl ketone, methyl 1-methylvinyl ketone, ethyl vinyl ketone, n-propyl vinyl ketone, diacetone acrylamide or diacetone acrylate, preferably methyl vinyl ketone, ethyl vinyl ketone, diacetone acrylamide or diacetone acrylate; reacting the polymerized product with a compound represented by the following general formula (g):

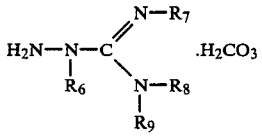

(g)

(wherein $R_6$ to $R_9$ are the same as those defined above) such as aminoguanidine bicarbonate, N-amino-N'-methylguanidine bicarbonate or N-amino-N'-ethylguanidine bicarbonate, preferably aminoguanidine bicarbonate; and further converting the product to a guanidium salt with a compound of the formula: H—X (wherein X is the same as defined above) such as hydrogen chloride, hydrogen bromide, sulfuric acid, acetic acid or nitric acid.

The aforementioned polymerization reaction may be carried out according to any polymerization technique such as solution polymerization, emulsion polymerization, suspension polymerization or dispersion polymerization, preferably solution polymerization or emulsion polymerization.

The foregoing solution polymerization is performed in the presence of a radical polymerization initiator (inclusive of simultaneous use of potassium persulfate and sodium hydrogen sulfite; those available from WAKO JUNYAKU CO., LTD. under the trade name of V-50, V-65, V-601), at a temperature generally ranging from 30° to about 120° C., preferably 40° to about 100° C.

The foregoing emulsion polymerization is carried out at a temperature generally ranging from 30° to about 100° C., preferably 40° to about 80° C., in the presence of at least one emulsifying agent selected from the group consisting of anionic surfactants such as sodium dodecyl sulfate and Triton 770 (available from Rohm & Haas Co., Ltd.), cationic surfactants such as octadecyl trimethylammonium chloride, nonionic surfactants such as Emarex NP-20 (available from NIPPON EMULSION CO., LTD.), gelatin and polyvinyl alcohol and a radical polymerization initiator (such as a combination of potassium persulfate and sodium hydrogen sulfite, and one available from WAKO JUNYAKU CO., LTD. under the trade name of V-50).

The formation of ammonium salt, i.e., the reaction for converting the polymerized product to ammonium salts is generally conducted at a temperature ranging from −10° to about 40° C., particularly 0° to 30° C.

In the present invention, all the processes for manufacturing the polymers used un the invention can be performed in one container and the polymers can very easily prepared.

Synthesis of the typical polymers used in the invention are as follows:

PREPARATION 1

Synthesis of Polymer Dispersion (16), Poly(divinylbenzene-co-styrene-co-N,N-diethyl-N-methacryloyloxyethylammonium chloride)

Distilled water (108 g) was charged into a reaction vessel, degassed with nitrogen gas, heated to 60° C. under nitrogen stream, followed by adding 7.9 g of 23% octadecyl trimethylammonium chloride, 0.04 g of polyvinyl alcohol (degree of saponification=95%), 0.78 g of styrene, 2.94 g of divinyl benzene and 20.63 g of N,N-diethylaminoethyl methacrylate and stirring the resultant mixture. To the mixture there was added a solution obtained by dissolving 0.44 g of potassium persulfate, and 0.14 g of sodium hydrogen sulfite in 10.8 g of distilled water degassed with nitrogen gas and the mixture was stirred for 5 hours, then, it was cooled to room temperature, followed by adding a solution of conc. hydrochloric acid (10.6 g) in 100 g of distilled water, filtering the mixture to recover a polymer dispersion whose solid content was 14.0% by weight and whose amine content was $4.59\times10^{-4}$ eq./g.

PREPARATION 2

Synthesis of Polymer Dispersion (34), Poly(divinylbenzene-co-diethylaminomethyl styrene sulfate Distilled water (1,100 g) was charged into a reaction vessel, was degassed with nitrogen gas, followed by adding 16.6 g of sodium dodecylsulfate, 1.9 g of sodium hydroxide, 1.4 g of sodium sulfite, 33.6 g of divinylbenzene and 195.7 g of diethylaminomethyl styrene and stirring.

The mixture was heated to 60° C., a solution of 0.9 g of potassium persulfate in 60 g of distilled water was added thereto every one hour (4 times in all) and stirring was continued for 2 hours. Then, the mixture was cooled to room temperature, a solution of 48.9 g of conc. sulfuric acid in 313 g of distilled water was added to the mixture, and the mixture was filtered to recover a polymer dispersion having a solid content of 15.4% by weight and an amine content of $5.29\times10^{-4}$ eq./g.

PREPARATION 3

Synthesis of Polymer Dispersion (15), Poly(ethylene glycol dimethacrylate-co-tert-butyl methacrylate-co-triethylammoniomethyl styrene chloride To a reaction vessel there were added 2.8 g of an emulsifying agent (available from Nippon Oil & Fats Co., Ltd. under the trade name of NISSAN TRACKS H-45), 75 g of distilled water, 5.95 g of ethylene glycol dimethacrylate, 4.98 g of tert-butyl-methacrylate and 5.34 g of chloromethyl styrene and then the mixture was stirred. After heating it to 60° C., 0.2 g of a polymerization initiator available from WAKO JUNYAKU CO., LTD. under the trade name of V-50 was added and the stirring was continued for 3 hours. Then the mixture was cooled to 40° C., followed by adding 108 g of distilled water and 62 g of isopropyl alcohol, dropwise adding 3.49 g of triethylamine over 15 minutes, stirring the mixture at 70° C. for 2 hours, and filtering it to recover a polymer dispersion having a solid content of 8.50% by weight and an amine content of $1.31\times10^{-4}$ eq./g.

PREPARATION 4

A Solution of Poly(N'-ethyl-N-vinylimidazolium Bromide) (33)

Dimethylacetamide (100 g) was charged into a reaction vessel, was degassed with nitrogen gas, followed by adding 23.5 g of N-vinylimidazole under nitrogen stream and stirring the mixture. After heating it to 80° C., 0.6 g of a polymerization initiator available from WAKO JUNYAKU under the trade nameof V-601 was added thereto, followed by stirring it for 4 hours, aditionally adding 0.6 g of V-601, and stirring it for additional 2 hours. Then the mixture was cooled to about 25° C., 100 g of ethyl alcohol was added thereto. 49.5 g of hexyl bromide was dropwise added to the mixture over 30 minutes and it was stirred for 2 hours at 70° C. The resultant solution was poured into 3 l of acetone, resultant precipitates were recovered by filtration, washed with 1 l of acetone, dried at room temperature under a reduced pressure to thus obtain 68.2 g of solid polymer (water-soluble polymer).

Other polymers may likewise be synthesized in the same manner.

The term "solution having fixing ability" herein means bleach-fixing solutions and fixing solutions.

The compounds of formula (I) used in the invention can be incorporated into processing solutions by directly mixing the compounds in the form of a latex or in the form of a polymer soluble in water with the processing solution, or bringing the compounds into contact with the processing solution through a separating membrane such as semi-permeable membrane. Examples of such semi-permeable membranes include cellophane membrane, collodion membrane, cellulose membrane, parchment paper and animal membrane. The contact between the compound and the processing solution can be achieved by forming these semi-permeable membranes into a bag, packing the bag with the polymeric compounds and immersing the bag into the processing solution.

In addition, since the present invention does not use polymer particles which are water-insoluble and incompatible with water, such as the conventional ion-exchange resins, but uses a specific polymer dispersion and/or water-soluble polymer defined by formula I, there can be obtained good advantages in case of processing photographic materials, i.e., the photographic material having no damage such as scratch by adding the dispersion or the water-soluble polymer directly to the solution having a fixing ability.

The amount of the compounds represented by formula (I) preferably ranges from 1 to 50 g (solid content) per one l of the processing solution, more preferably 5 to 30 g/l.

The light-sensitive materials to be processed by the method of the present invention is characterized by comprising at least one layer obtained from a silver halide emulsion containing not less than one mole%, preferably 5 to 25 mole% and more preferably 7 to 20 mole% of silver iodide.

Therefore, such a light-sensitive material may be prepared by applying one or more of such emulsion layers to the surface of a substrate utilizing at least one silver halide selected from the group consisting of silver iodide, silver iodobromide, silver chloroiodobromide and silver chloroiodide. In addition to silver iodide, other silver halide such as silver chloride and silver bromide may be used optionally.

Silver halide grains present in the photographic emulsions used in the color photographic light-sensitive materials to be processed by the invention may be so-called regular grains having regular crystal shape such as cubic, octahedral, dodecahedral or tetradecahedral or those having irregular crystal shape such as spheric or tabular shape or those having composite forms thereof. Moreover, they may be tabular grains having an aspect ratio of not less than 5 as disclosed in Research Disclosure, Vol. 225, pp. 20–58 (January, 1983).

The grains may be those having epitaxial structure, or may be those composed of multilayered structure in which composition (such as silver halide composition) differs between the inner portion and the surface portion thereof.

The average grain size is preferably not less than 0.5μ, more preferably not less than 0.7μ and not more than 5.0μ.

In the silver halide emulsion, the grain size distribution may be wide or narrow. The latter is known as so-called monodisperse one and the dispersion coefficient thereof is preferably not more than 20%, more preferably not more than 15%. In this respect, the term "dispersion coefficient" herein means the standard deviation which is divided by average grain size.

The photographic emulsion may comprise any combination of silver chloride, silver bromide, silver iodide, silver iodobromide, silver chloroiodobromide and silver chloroiodide.

The amount of coated silver of the light-sensitive materials to be processed by the method of the invention is preferably 1 to 20 g/m$^2$, in particular 2 to 10 g/m$^2$ and the total amount of iodine (AgI) present in the silver halide light-sensitive materials is preferably not less than $4\times10^{-3}$ mole/m$^2$ and more preferably $6\times10^{-3}$ to $4\times10^{-2}$ mole/m$^2$.

When forming silver halide grains or during the physical ripening stage, other salts or complexes such as cadmium salts, zinc salts, lead salts, thallium salts, iridium salts or complex salts thereof, rhodium salts or complex salts thereof and/or iron salts or complex salts thereof and the silver halide grains may coexist.

The light-sensitive materials to be processed by the method of the invention is characterized in that they comprise emulsion layer(s) containing silver iodide. Other constructions thereof will be described in detail below.

TREATMENT OF THE EMULSION LAYER AND USUAL ADDITIVES

The silver halide emulsion used in the invention is generally physically and/or chemically ripened and spectrally sensitized. The additives used in such processes are disclosed in Research Disclosure (RD), Vol. 176, No. 17643 (December, 1978) and ibid, Vol. 187, No. 18716 (November, 1979) and the relevant passages thereof are listed in the following Table.

Known additives for photograph usable in the present invention are also described in the aforementioned two articles (Research Disclosure) and thus the relevant passages thereof are also listed in the following Table.

| Kind of additive | RD 17643 | RD 18716 |
|---|---|---|
| 1. Chemical Sensitizer | p. 23 | p. 648, right column |
| 2. Sensitivity Enhancing Agent | | " |
| 3. Spectral Sensitizing Agent | p. 23–24 | p. 648, right column~ |
| 4. Supersensitizing Agent | | p. 649, right column |
| 5. Brightener | p. 24 | |
| 6. Antifoggant and Stabilizer | p. 24–25 | p. 649, right column |
| 7. Coupler | p. 25 | |
| 8. Organic Solvent | p. 25 | |
| 9. Light Absorber, Filter Dye | p. 25–26 | p. 649, right column~ p. 650, left column |
| 10. Ultraviolet Absorber | " | " |
| 11. Stain Resistant Agent | p. 25, right column | p. 650, right to left column |
| 12. Dye Image Stabilizer | p. 25 | |
| 13. Film Hardening Agent | p. 26 | p. 651, left column |
| 14. Binder | p. 26 | " |
| 15. Plasticizer, Lubricant | p. 27 | p. 650, right column |
| 16. Coating Aid, Surfactant | p. 26–27 | " |
| 17. Antistatic Agent | p. 27 | " |

COLOR COUPLER

The light-sensitive materials to be processed by the method of the invention may comprise color couplers. The term "color coupler(s)" herein means a compound capable of forming a dye through a coupling reaction with an oxidized form of an aromatic primary amine developing agent. Typical examples of useful color couplers include naphthol or phenol type compounds, pyrazolone or pyrazoloazole type compounds and linear or heterocyclic ketomethylene compounds. Cyan, magenta and yellow color couplers which may be used in the present invention are disclosed in Research Disclosure No. 17643 (December, 1978) VII-D; and ibid No. 18717 (November, 1979).

The color couplers incorporated in light-sensitive materials are preferably made nondiffusible by imparting thereto ballast group(s) or polymerizing them. 2-Equivalent couplers which are substituted with coupling elimination groups are more preferable than 4-equivalent couplers in which a hydrogen atom is in a coupling active site, because the amount of coated silver can be decreased. Furthermore, couplers in which a formed dye has a proper diffusibility, non-color couplers, DIR couplers which release a development inhibitor through coupling reaction or couplers which release a development accelerator during coupling reaction may also be used.

Typical yellow couplers usable in the present invention is an acylacetamide coupler of an oil protect type. Examples of these are disclosed in U.S. Pat. Nos. 2,407,210; 2,875,057; and 3,265,506. 2-Equivalent yellow couplers are preferably used in the present invention. Typical examples thereof include the yellow couplers of an oxygen atom elimination type as disclosed in U.S. Pat. Nos. 3,408,194; 3,447,928; 3,933,501; and 4,022,620, or the yellow couplers of a nitrogen atom elimination type as described in J.P. KOKOKU No. 55-10739; U.S. Pat. Nos. 4,401,752; and 4,326,024, Research Disclosure No. 18053 (April, 1979), U.K. Patent. No. 1,425,020, DEOS Nos. 2,219,917; 2,261,361; 2,329,587 and 2,433,812. α-pivaloyl acetanilide type couplers are excellent in fastness, particularly light fastness, of formed dye. α-benzoyl acetanilide type couplers yield high color density.

Magenta couplers usable in the present invention include couplers of an oil protected type of indazolone, cyanoacetyl, or preferably pyrazoloazole such as 5-pyrazolone and pyrazolotriazole type ones. Among 5-pyrazolone type couplers, couplers whose 3-position is substituted with an arylamino or acylamino group are preferred from the viewpoint of color phase and color density of the formed dye. Typical examples thereof are disclosed in U.S. Pat. Nos. 2,311,082; 2,343,703, 2,600,788; 2,908,573; 3,062,653; 3,152,896 and 3,936,015. An elimination group of the 2-equivalent 5-pyrazolone type couplers is preferably a nitrogen atom elimination group disclosed in U.S. Pat. No. 4,310,619 and an arylthio group disclosed in U.S. Pat. No. 4,351,897. The 5-pyrazolone type couplers having ballast groups such as those disclosed in European Patent No. 73,636 provide high color density.

As examples of pyrazoloazole type couplers, there may be mentioned such pyrazolobenzimidazoles as those disclosed in U.S. Pat. No. 3,369,897, preferably pyrazolo(5,1-c)(1,2,4)triazoles disclosed in U.S. Pat. No. 3,725,067; pyrazolotetrazoles disclosed in Research Disclosure No. 24220 (June, 1984) and pyrazolopyrazoles disclosed in Research Disclosure No. 24230 (June, 1984). Imidazo(1,2-b)pyrazoles such as those disclosed in European Patent No. 119,741 are preferred on account of small yellow minor absorption of the formed dye and light fastness. Pyrazolo(1,5-b)(1,2,4)triazoles such as those disclosed in European Patent No. 119,860 are particularly preferred.

Cyan couplers usable in the present invention include naphtholic or phenolic couplers of an oil protect type. Typical examples of naphthol type couplers are those disclosed in U.S. Pat. No. 2,474,293. Typical preferred 2-equivalent naphtholic couplers of oxygen atom elimination type are disclosed in U.S. Pat. Nos. 4,052,212; 4,146,396; 4,228,233; and 4,296,200. Typical phenol type couplers are those disclosed in U.S. Pat. Nos. 2,369,929; 2,801,171; 2,772,162; and 2,895,826.

Cyan couplers resistant to humidity and heat are preferably used in the present invention. Examples of such couplers are phenol type cyan couplers which have an alkyl group having at least two carbon atoms at a meta-position of a phenolic nucleus as disclosed in U.S. Pat. No. 3,772,002; 2,5-diacylamino-substituted phenol type couplers as disclosed in U.S. Pat. Nos. 2,772,162; 3,758,308; 4,126,396; 4,334,011; and 4,327,173; DEOS No. 3,329,729 and J.P. KOKAI No. 59-166956; and phenol type couplers having a phenylureido group at 2-position and an acylamino group at 5-position of the phenol nucleus as disclosed in U.S. Pat. Nos. 3,446,622; 4,333,999; 4,451,559 and 4,427,767.

Graininess may be improved by using together a coupler which can form a dye having a moderate diffusibility. As such dye-forming couplers, some magenta couplers are specifically disclosed in U.S. Pat. No. 4,366,237 and U.K. Pat. No. 2,125,570 and some yellow, magenta and cyan couplers are specifically disclosed in European Pat. No. 96,570 and DEOS No. 3,234,533.

Dye-forming couplers and aforementioned special couplers may be a dimer or a higher polymer. Typical examples of such polymerized dye-forming couplers are disclosed in U.S. Pat. Nos. 3,451,820 and 4,080,211. Examples of such polymerized magenta couplers are disclosed in U.K. Patent No. 2,102,173 and U.S. Pat. No. 4,367,282.

In the present invention, at least two such couplers may be added to a single layer or one such coupler may be added to two or more different layers to impart desired properties to the light-sensitive materials.

The standard amount of the color couplers is 0.001 to 1 mole per mole of light-sensitive silver halide and preferably 0.01 to 0.5 moles for yellow couplers, 0.003 to 0.3 moles for magenta couplers and 0.002 to 0.3 moles for cyan couplers.

The couplers used in the present invention can be introduced, into the light-sensitive materials, by a variety of known method for dispersion. Examples of high boiling point organic solvents used in the oil-in-water dispersion method are disclosed in U.S. Pat. No. 2,322,027. Specific examples of processes, effects and latexes for impregnation for latex dispersion method are, for instance, disclosed in U.S. Pat. No. 4,199,363 and DE OLS Nos. 2,541,274 and 2,541,230.

SUBSTRATE

The light-sensitive material or emulsion processed by the method of the present invention are applied to the surface of a substrate commonly used such a flexible substrate as a plastic film (e.g., cellulose nitrate, cellulose acetate and polyethylene terephthalate) and paper or such a rigid substrate as a glass plate. Substrates and coating methods are detailed in Research Disclosure, Vol. 176, No. 17643, Items XV (p. 27) and XVII (p. 28) (December, 1978).

The processing method of the present invention can be applied to the processing of color negative films for general use or moving pictures; color reversal films, color paper, color positive films and color reversal paper for slides or television; monochromatic films and monochromatic paper.

METHOD FOR DEVELOPMENT PROCESSING

In the processing method of the present invention, the amount of replenishers for processing solutions, in particular the processing solution having fixing ability is limited to not more than 1,000 ml, preferably 100 to 500 ml, more preferably 100 to 300 ml per 1 $m^2$ of the light-sensitive material to be processed and thus remarkable effects of the invention can be attained.

The processing method of this invention comprises a variety of combinations of various processes and specific examples thereof are as follows:

(i) development—bleaching—fixing—water washing—drying
(ii) development—bleaching—fixing—water washing—stabilization—drying
(iii) development—bleaching—fixing—stabilization—drying
(iv) development—bleach-fixing—water washing—drying
(v) development—bleach-fixing—stabilization—drying
(vi) development—bleach-fixing—water washing—stabilization—drying
(vii) development—bleaching—bleach-fixing—water washing—drying
(viii) development—bleaching—bleach-fixing—water washing—stabilization—drying
(ix) development—bleaching—bleach-fixing—stabilization—drying In the above examples, water washing process can be carried out between development and bleaching or bleach-fixing processes and/or between bleaching and fixing processes. In this respect, the processing baths may comprise a single bath, or may be other system such as multistage countercurrent system or multistage direct flow system. The foregoing development process may comprise reversal color development process which conmprises monochromatic development—water washing—reversal—color development.

DEVELOPMENT

The color developing solution used to develop a light-sensitive material is preferably an alkaline solution principally containing an aromatic primary amine type color developing agent. As such color developing agent, aminophenol type compounds may be used, but preferably p-phenylenediamine type compounds are used and typical examples thereof include 3-methyl-4-amino-N,N-diethyl aniline, 3-methyl-4-amino-N-ethyl-N-β-hydroxyethyl aniline, 3-methyl-4-amino-N-ethyl-N-β-methanesulfonamidoethyl aniline, 3-methyl-4-amino-N-ethyl-N-β-methoxyethyl aniline and sulfates, hydrochlorides or p-toluenesulfonates thereof. These diamines in the form of salts are in general more stable than those in free state and, therefore, they are preferably used in the form of salts.

The color developer used in the method of the present invention generally contains a pH buffering agent such as carbonates, borates or phosphates of alkali metals; development inhibitors or antifoggants such as bromides, iodides, benzimidazoles, benzothiazoles or mercapto compounds. Moreover, it may further contain, if necessary, various preservatives such as hydroxylamine, diethylhydroxylamine, sulfites and those disclosed in J.P. KOKAI No. 63-135938; organic solvents such as triethanol amine and diethylene glycol; development accelerators such as benzyl alcohol, polyethylene glycol, quaternary ammonium salts and amines; fogging agents such as dye-forming couplers, competing couplers and sodium borohydride; auxiliary developing agents such as 1-phenyl-3-pyrazolidone, thickening agents, various chelating agents such as aminopolycarboxylic acids, aminopolyphosphonic acids, alkylphosphonic acids and phosphonocarboxylic acids; and antioxidant such as those disclosed in OLS No. 2,622,950 and the like.

Moreover, when such a reversal processing is carried out, the color development is in general performed after carrying out the monochromatic development. The monochromatic developer may comprise a monochromatic developing agent such as dihydroxybenzenes, for instance, hydroquinone; 3-pyrazolidones, for instance, 1-phenyl-3-pyrazolidone; or aminophenols, for instance, N-methyl-p-aminophenol which may be used alone or in combination.

The amount of these color developer and monochromatic developer to be supplemented vary depending on the kind of the color photographic light-sensitive materials to be processed, but it is in general not more than 3 l per 1 $m^2$ of the light-sensitive material processed. The amount thereof can be reduced to not more than 500 ml per 1 $m^2$ of the light-sensitive material if the concentration of bromide ions present in the replenishers can be reduced. When the amount of the replenisher is reduced, it is preferable to make the area of the opening of the processing baths small to thus prevent evaporation of the processing solution and air-oxidation of the solutions. It is also possible to reduce the amount of the replenisher through the use of a means for restricting the accumulation of bromide ions in the developer.

BLEACHING; FIXING

The photographic emulsion layer after color development is in general bleached. The bleaching process and the fixing process may be performed simultaneously or separately. Moreover, to achieve rapid processing, the light-sensitive materials may be bleach-fixed after bleaching process. In the method of the invention, the light-sensitive materials may be fixed prior to the bleach-fixing treatment or may be bleached after the bleach-fixing treatment depending on the purposes. As the bleaching agents, there may be used such a compound of polyvalent metal as those of iron(III), cobalt(III), chromium(IV) or copper(II), peracids, quinones and nitroso compounds. Typical bleaching agents include ferricyanides; bichromates; organic complexes of iron(III) or cobalt(III) such as complexes of aminopolycarboxylic acids, for instance, ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid or organic acids, for instance, citric acid, tartaric acid and malic acid; persulfates; bromates; manganates; and nitrosophenol. Among these, ferric aminopolycarboxylates such as ferric ethylenediaminetetraacetate are preferred from the viewpoint of rapid processing and environmental protection. In particular, the ferric aminopolycarboxylate complexes are useful in both the separate bleaching solution and one-bath bleach-fixing solution.

The bleaching and bleach-fixing solutions and the bath preceeding the same may optionally contain a bleaching accelerator. Examples of useful bleaching accelerators are compounds represented by the following general formulas (III) to (IX); thiourea derivatives; polyethylene oxides; polyamine compounds; and bromide ions.

These bleaching accelerators may also be added to the light-sensitive materials to be processed. These bleaching accelerators are particularly effective in the bleach-fixing of color light-sensitive materials for taking photographs.

Examples of fixing agents include thiosulfates, thiocyanates, thioether type compounds, thioureas and a large amount of iodides, but generally thiosulfates are used and particularly ammonium thiosulfate is most commonly employed. As the preservatives for the bleach-fixing or fixing solution, preferred are sulfites, bisulfites, carbonylbisulfite adducts or sulfinic acid compounds.

If the processing solution having fixing ability used in the present invention is a bleach-fixing solution, a bleaching accelerator is preferably used.

The bleaching accelerators used in the bleach-fixing solution or the bath preceeding the same as well as the light-sensitive materials are selected from the group consisting of compounds having mercapto group(s) or disulfide bond(s); thiazoline derivatives; thiourea derivatives; and isothiourea derivatives so far as they exhibit bleaching accelerating effect, but are preferably selected from the compounds represented by the following general formulas (III) to (IX):

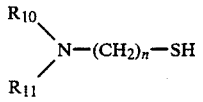

Compounds (III)

In formula (III), $R_{10}$ and $R_{11}$ may be the same or different and each represents a hydrogen atom, an unsubstituted or substituted lower alkyl group, preferably those having 1 to 5 carbon atoms, in particular a methyl, ethyl or propyl group; or an acyl group, preferably those having 1 to 3 carbon atoms, such as an acetyl or propionyl group; and n is an integer ranging from 1 to 3. $R_{10}$ and $R_{11}$ may be bonded together to form a ring. $R_{10}$ and $R_{11}$ each preferably represents an unsubstituted or substituted lower alkyl group among others. Examples of substituents of $R_{10}$ and $R_{11}$ are a hydroxyl group, a carboxyl group, a sulfo group and an amino group.

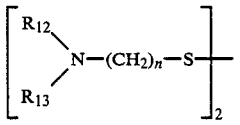

Compounds (IV)

In formula (IV), $R_{12}$ and $R_{13}$ are the same as those defined above in connection with $R_{10}$ and $R_{11}$ respectively and n is an integer ranging from 1 to 3. $R_{12}$ and $R_{13}$ may be bonded to one another to form a ring. Particularly preferred $R_{12}$ and $R_{13}$ are unsubstituted or substituted lower alkyl groups. Examples of substituents of $R_{12}$ and $R_{13}$ are a hydroxyl group, a carboxyl group, a sulfo group and an amino group.

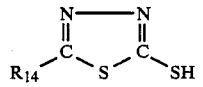

Compounds (V)

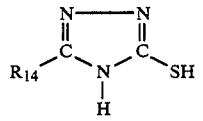

Compounds (VI)

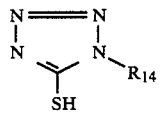

Compounds (VII)

In formulas (V) to (VII), $R_{14}$ represents a hydrogen atom, a halogen atom such as a chlorine or bromine atom; an amino group; an unsubstituted or substituted lower alkyl group, preferably those having 1 to 5 carbon atoms, particularly a methyl, ethyl or propyl group; an amino group having alkyl group(s) such as a methylamino, ethylamino, diethylamino or dimethylamino group. Examples of substituents of $R_{14}$ are a hydroxyl group, a carboxyl group, a sulfo group and an amino group.

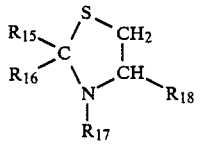

Compounds (VIII)

In formula (VIII), $R_{15}$ and $R_{16}$ may be the same or different and each represents a hydrogen atom, an optionally substituted alkyl group, preferably a lower alkyl group such as a methyl, ethyl or propyl group; an optionally substituted phenyl group; or an optionally substituted heterocyclic group, more specifically those comprising at least one hetero-atom such as nitrogen, oxygen and sulfur atoms, such as groups derived from pyridine ring, thiophene ring, thiazolidine ring, benzoxazole ring, benzotriazole ring, thiazole ring, imidazole ring; $R_{17}$ represents a hydrogen atom or an optionally substituted lower alkyl group, preferably those having 1 to 3 carbon atoms such as a methyl or ethyl group. Examples of substituents of $R_{15}$ to $R_{17}$ are a hydroxyl group, a carboxyl group, a sulfo group and an amino group. $R_{18}$ represents a hydrogen atom or a carboxyl group.

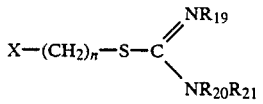

Compounds (IX)

In formula (IX), $R_{19}$ to $R_{21}$ may be the same or different and each represents a hydrogen atom or a lower alkyl group, preferably having 1 to 3 carbon atoms such as a methyl or ethyl group, provided that $R_{19}$ and $R_{20}$ or $R_{21}$ may be bonded together to form a ring. X represents an amino, sulfonic acid or carboxyl group which may have substituents such as lower alkyl group(s), for instance, methyl group(s), alkoxyalkyl group(s), for instance, acetoxymethyl group(s). Particularly preferred $R_{19}$ to $R_{21}$ are a hydrogen atom, a methyl group or an ethyl group and preferred X is an amino group or a dialkylamino group.

Specific examples of these compounds (III) to (IX) are listed below.

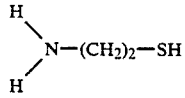

(III)-1

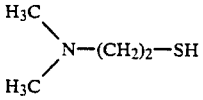

(III)-2

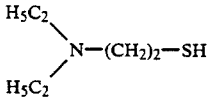

(III)-3

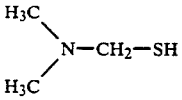

(III)-4

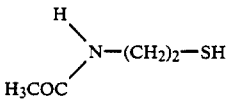

(III)-5

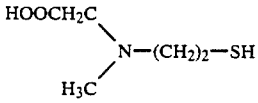

(III)-6

-continued

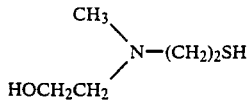

(III)-7

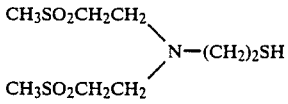

(III)-8

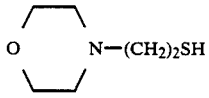

(III)-9

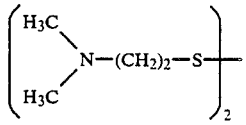

(IV)-1

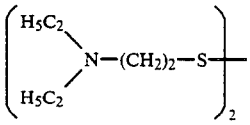

(IV)-2

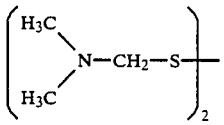

(IV)-3

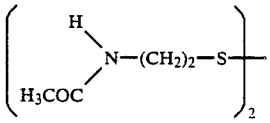

(IV)-4

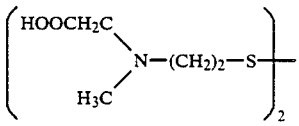

(IV)-5

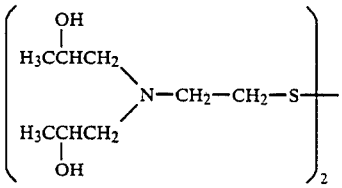

(IV)-6

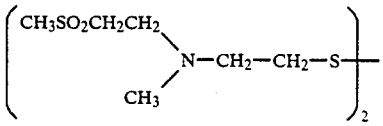

(IV-7)

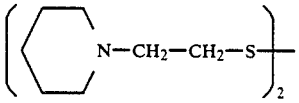

(IV)-8

-continued
(IV)-9
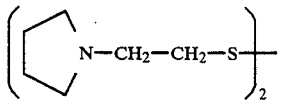
(IV-10)
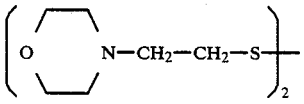
(V)-1
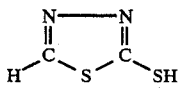
(V)-2
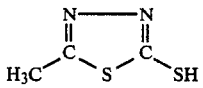
(V)-3
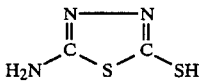
(V)-4
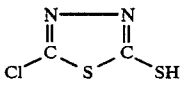
(V)-5
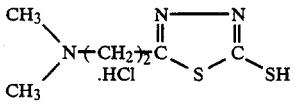
(V)-6
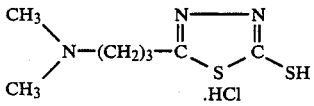
(VI)-1
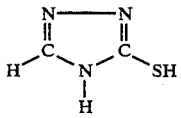
(VI)-2
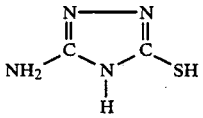
(VI)-3
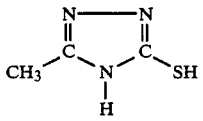
(VII)-1
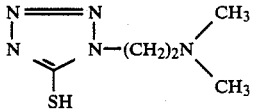
(VII)-2
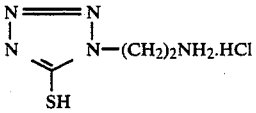
-continued
(VIII)-1
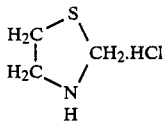
(VIII)-2
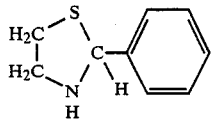
(VIII)-3
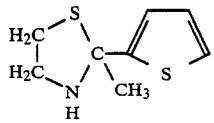
(VIII-4)
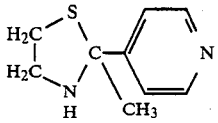
(VIII)-5
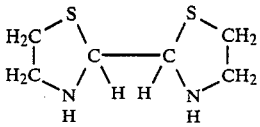
(VII)-6
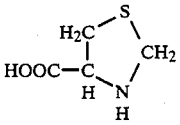
(IX)-1
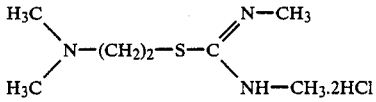
(IX)-2
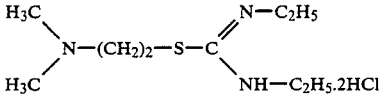
(IX)-3
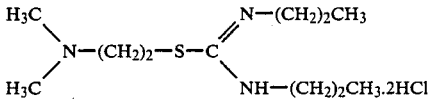
(IX)-4
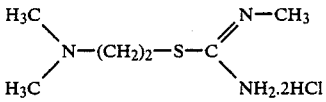
(VIX)-5
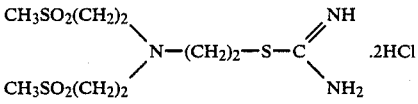
(IX)-6
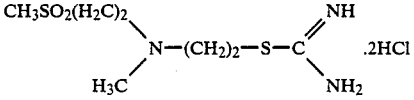
(IX)-7
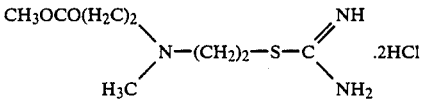

-continued

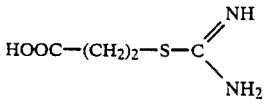

(IX)-8

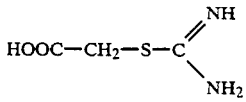

(IX)-9

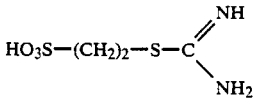

(IX)-10

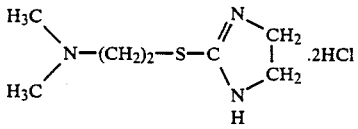

(IX)-11

All these compounds can be prepared in accordance with conventional methods. In particular, reference can be made to U.S. Pat. No. 4,285,984, G. Schwarzenbach et al., Helv. Chim. Acta., 1955, 38, 1147 and R. O. Clinton et al., J. Am. Chem. Soc., 1948, 70, 950 for compounds (III); to J.P. KOKAI No. 53-95630 for compounds (IV); to J.P. KOKAI No. 54-52534 for compounds (V) and (VI); to J.P. KOKAI Nos. 51-68568, 51-70763 and 53-50169 for compounds (VII); to J.P. KOKOKU No. 53-9854 and J.P. KOKAI No. 59-214855 for compounds (VIII); and to J.P. KOKAI No. 53-94927 for compounds (IX).

In addition, compounds as disclosed in J.P. KOKAI No. 62-9346 can be used as bleaching accelerators.

The amount of the bleaching accelerators in the bleach-fixing solution or the bath preceeding the same varies depending on the kind of the light-sensitive material to be processed, processing temperature, time required for each intended processing, but it desirably ranges from $1\times10^{-5}$ to $10^{-1}$ mole, preferably $1\times10^{-4}$ to $5\times10^{-2}$ mole per l of the processing solution.

The bleaching accelerator is in general added to a processing solution in the form of a solution prepared by dissolving the same in water, an alkali, an organic acid, an organic solvent or the like. However, it may also be added directly to such processing solutions or the preceeding baths in the form of powder.

WATER WASHING; STABILIZATION

The silver halide color photographic light-sensitive materials are generally subjected to water washing and/or stabilization processes after desilvering process.

The amount of washing water widely varies depending on properties of the light-sensitive materials such as the kinds of materials, for instance, couplers used; applications, the temperature of the washing water, the number of washing tanks (number of steps), manners of supplementation such as direct flow system and counter current flow system and other various conditions. Among these, the relation between the number of water washing tanks and the amount of water in the multistage counter current flow systems can be obtained according to the method disclosed in "Journal of the Society of Motion Picture and Television Engineers", Vol. 64, pp. 248–253 (May, 1955).

If such a multistage counter current flow system as disclosed in the foregoing article is adopted, the amount of washing water can substantially be reduced, but bacteria proliferate and the resulting floating substances are adhered to the processed light-sensitive materials since the residence time of water in the tanks is greatly increased. In the processing method of the color light-sensitive materials, such a problem can effectively be solved by adopting the method for reducing the amount of calcium and magnesium ions disclosed in U.S. Ser. No. 057254 filed on June 3, 1987. Alternatively, this problem can also be solved by using isothiazolone compounds and thiabendazoles disclosed in J.P. KOKAI No. 57-8542; such chlorine type antibacterial agents as sodium chlorinated isocyanurates; benzotriazoles; or other antibacterial agents disclosed in "BOKIN BOBAIZAI NO KAGAKU (Chemistry of Antibacterial and Antifungus agents)", Hiroshi HORIGUCHI; "BISEIBUTSU NO MEKKIN, SAKKIN AND BOBAI GIJUTSU (Sterilization, Pasteurization and Mold Controlling Techniques)", edited by Sanitary Engineering Society; and "Dictionary of Antibacterial and Antifungus Agents", edited by Japan Bacteria and Fungi Controlling Society.

In the present invention, the pH value of the washing water is 4 to 9 and preferably 5 to 8. The temperature and time of the water washing process may vary depending on, for instance, the properties and applications of the light-sensitive materials to be processed, but in general the water washing is performed at a temperature ranging from 15° to 45° C. for 20 seconds to 10 minutes, preferably 25° to 40° C. for 30 seconds to 5 minutes.

In the invention, the light-sensitive materials are directly processed with a stabilization solution in place of the water washing process. In such a stabilization process, any known methods disclosed in J.P. KOKAI Nos. 57-8543, 58-14834 and 60-220345 can be employed.

Additionally, the stabilization process may be carried out subsequent to the water washing process and examples thereof are stabilization baths containing formalin and a surfactant, which is used as a final bath for processing color light-sensitive materials for taking photographs. The stabilization solution may contain a variety of chelating agents and/or antifungus agents.

The overflows accompanied by the supplementation of a replenisher to the water washing and/or stabilization processings may be introduced into other baths such as those for the desilvering process to reuse them.

The silver halide color light-sensitive materials processed by the invention may contain a color developing agent for the purposes of simplification and speeding up of the processing. To incorporate such a color developing agent into the light-sensitive materials, it is preferred to use a variety of precursors thereof. Examples of such precursors are indoaniline type compounds as disclosed in U.S. Pat. No. 3,342,597; Schiff base type compounds as disclosed in U.S. Pat. No. 3,342,599, and Research Disclosure Nos. 14850 and 15159; aldor compounds as discloxsed in Research Disclosure No. 13924; metal salt complexes as disclosed in U.S. Pat. No. 3,719,492; and urethane type compounds as disclosed in J.P. KOKAI No. 53-135628.

The color light-sensitive materials processed by the invention may optionally comprise a variety of 1-phenyl-3-pyrazolidones for the purpose of promoting the color development. Typical examples of such compounds are those disclosed in J.P. KOKAI Nos. 56-64339, 57-144547 and 58-115438.

In the present invention, each processing solution is used at a temperature ranging from 10° to 50° C. It genrally ranges from 33° to 38° C., but higher temperature may be used to promote the processing and to thus reduce the processing time or lower temperature may also be used to improve the quality of images or the stability of the procerssing solution. Moreover, to save the amount of silver in the color light-sensitive materials, processings utilizing cobalt intensifier or hydrogen peroxide intensifier disclosed in West German Patent No. 2,226,770 and U.S. Pat. No. 3,674,499 can be employed.

Each processing bath may be provided with a heater, a temperature sensor, a level sensor, a circulation pump, a filter, a floating cover, a squeezy and the like according to need.

In addition, in a continuous processing, a constant finishing can be achieved by preventing the variation in the composition of the solution with the addition of a replenisher for each processing solution. In such a case, the amount of the replenisher can be reduced to not more than ½ times the standard amount of replenisher for saving cost.

Thus, according to the method of the invention, iodide ions present in the processing solutions having fixing ability such as fixing and/or bleach-fixing solutions can selectively and rapidly be removed therefrom through the use of at least one member selected from the group consisting of specific water-soluble polymers and specific polymer dispersions. Therefore, silver halide (color) light-sensitive materials can be rapidly processed while substantially reducing the amount of the replenishers or the amount of waste liquor produced.

The method for processing silver halide light-sensitive materials according to the present invention will hereinafter be explained in more detail with reference to the following non-limitative working Examples and the effects practically achieved by the present invention will also be discussed in comparison with Comparative Examples given below.

EXAMPLE 1

Multilayered color light-sensitive materials (Samples 101 and 102) were prepared by applying in order coating solutions having the following compositions on the surface of a substrate of cellulose triacetate to which an underlying layer had been applied.

(i) Preparation of Sample 101 (Composition of the Light-sensitive Layer)

In the following composition, the coated amounts are expressed in g/m² of elemental silver for silver halide and colloidal silver; in g/m² for couplers, additives and gelatin; and in moles per mole of silver halide included in the same layer for sensitizing dye.

| | |
|---|---|
| 1st Layer: Halation Inhibiting Layer | |
| Black colloidal silver | 0.2 |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0.05 |
| 2nd Layer: Intermediate Layer | |
| Gelatin | 1.0 |
| UV-1 | 0.03 |

-continued

| | |
|---|---|
| ExC-4 | 0.02 |
| ExF-1 | 0.004 |
| Solv-1 | 0.1 |
| Solv-2 | 0.1 |
| 3rd Layer: Low Sensitive Red-sensitive Emulsion Layer | |
| Silver iodobromide emulsion (AgI = 4 mole %; uniform AgI type; diameter corresponding to sphere (DCS) = 0.5μ; variation coefficient of DCS (VC) = 20%; tabular grain; diameter/thickness ratio (D/T) = 3.0) | 1.2 (Ag) |
| Silver iodobromide emulsion (AgI = 3 mole %; uniform AgI type; diameter corresponding to sphere (DCS) = 0.3μ; variation coefficient of DCS (VC) = 15%; spherical grain; diameter/thickness ratio (D/T) = 1.0) | 0.6 (Ag) |
| Gelatin | 1.0 |
| ExS-1 | $4 \times 10^{-4}$ |
| ExS-2 | $4 \times 10^{-5}$ |
| ExC-1 | 0.05 |
| ExC-2 | 0.50 |
| ExC-3 | 0.03 |
| ExC-4 | 0.12 |
| ExC-5 | 0.01 |
| 4th Layer: High Sensitive Red-sensitive Emulsion Layer | |
| Silver iodobromide emulsion (AgI = 6 mole %; AgI content is high at the inner portion, core/shell ratio (C/S) = 1:1; DCS = 0.7μ; VC = 15%; tabular grain; D/T = 5.0) | 0.7 (Ag) |
| Gelatin | 1.0 |
| ExS-1 | $3 \times 10^{-4}$ |
| ExS-2 | $2.3 \times 10^{-5}$ |
| ExC-6 | 0.11 |
| ExC-7 | 0.05 |
| ExC-4 | 0.05 |
| Solv-1 | 0.05 |
| Solv-3 | 0.05 |
| 5th Layer: Intermediate Layer | |
| Gelatin | 0.5 |
| Cpd-1 | 0.1 |
| Solv-1 | 0.05 |
| 6th Layer: Low Sensitive Green-sensitive Emulsion Layer | |
| Silver iodobromide emulsion (AgI = 4 mole %; AgI content is high at the surface portion, C/S = 1:1; DCS = 0.5μ; VC = 15%; tabular grain; D/T = 4.0) | 0.35 (Ag) |
| Silver iodobromide emulsion (AgI = 3 mole %; uniform AgI type; diameter corresponding to sphere (DCS) = 0.3μ; variation coefficient of DCS (VC) = 25%; spherical grain; diameter/thickness ratio (D/T) = 1.0) | 0.20 (Ag) |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.02 |
| ExY-11 | 0.03 |
| Solv-1 | 0.3 |
| Solv-4 | 0.05 |
| 7th Layer: High Sensitive Green-sensitive Emulsion Layer | |
| Silver iodobromide emulsion (AgI = 4 mole %; AgI content is high at the inner portion, C/S = 1:3; DCS = 0.7μ; VC = 20%; tabular grain; D/T = 5.0) | 0.8 (Ag) |
| Gelatin | 0.5 |
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |
| ExM-14 | 0.01 |
| Solv-1 | 0.2 |
| Solv-4 | 0.01 |
| 8th Layer: Intermediate Layer | |
| Gelatin | 0.5 |
| Cpd-1 | 0.05 |
| Solv-1 | 0.02 |

-continued

| | |
|---|---|
| 9th Layer: Layer Imparting Interlayer Effect to Red-sensitive Layer | |
| Silver iodobromide emulsion (AgI = 2 mole %; AgI content is high at the inner portion, C/S = 2:1; DCS = 1.0μ; VC = 15%; tabular grain; D/T = 6.0) | 0.35 (Ag) |
| Silver iodobromide emulsion (AgI = 2 mole %; AgI content is high at the inner portion, C/S = 1:1; DCS = 0.4μ; VC = 20%; tabular grain; D/T = 6.0) | 0.20 (Ag) |
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |
| 10th Layer: Yellow Filter Layer | |
| Yellow colloidal silver | 0.05 |
| Gelatin | 0.5 |
| Cpd-2 | 0.13 |
| Solv-1 | 0.13 |
| Cpd-1 | 0.10 |
| 11th Layer: Low Sensitive Blue-sensitive Emulsion Layer | |
| Silver iodobromide emulsion (AgI = 4.5 mole %; uniform AgI type; diameter corresponding to sphere (DCS) = 0.7μ; variation coefficient of DCS (VC) = 15% tabular grain; diameter/thickness ratio (D/T) = 7.0) | 0.3 (Ag) |
| Silver iodobromide emulsion (AgI = 3 mole %; uniform AgI type; diameter corresponding to sphere (DCS) = 0.3μ; variation coefficient of DCS (VC) = 25%; tabular grain; diameter/thickness ratio (D/T) = 7.0) | 0.15 (Ag) |
| Gelatin | 0.5 |
| ExS-6 | $2 \times 10^{-4}$ |
| ExC-16 | 0.05 |
| ExC-2 | 0.10 |
| ExC-3 | 0.02 |

-continued

| | |
|---|---|
| ExY-13 | 0.07 |
| ExY-15 | 1.0 |
| Solv-1 | 0.20 |
| 12th Layer: High Sensitive Blue-sensitive Emulsion Layer | |
| Silver iodobromide emulsion (AgI = 10 mole %; AgI is high at the inner portion; DCS = 1.0μ; VC = 25%; multiple twin type tabular grain; D/T = 2.0 | 0.5 (Ag) |
| Gelatin | 0.5 |
| ExS-6 | $1 \times 10^{-4}$ |
| ExY-15 | 0.20 |
| ExY-13 | 0.01 |
| Solv-1 | 0.10 |
| 13th Layer: First Protective Layer | |
| Gelatin | 0.8 |
| UV-4 | 0.1 |
| UV-5 | 0.15 |
| Solv-1 | 0.01 |
| Solv-2 | 0.01 |
| 14th Layer: Second Protective Layer | |
| Fine grain silver bromide emulsion (AgI = 2 mole %; uniform AgI type; DCS = 0.07μ) | 0.5 |
| Gelatin | 0.45 |
| Poly(methyl methacrylate) particles (diameter = 1.5μ) | 0.2 |
| H-1 | 0.4 |
| Cpd-5 | 0.5 |
| Cpd-6 | 0.5 |

In addition to the foregoing components, there were added, to each layer, 0.04 g/m$^2$ of a stabilizer for the emulsion (Cpd-3) and 0.02 g/m$^2$ of a surfactant (Cpd-4) as a coating aid.

The chemical structures and chemical names of the compounds used in the foregoing coating compositions are as follows:

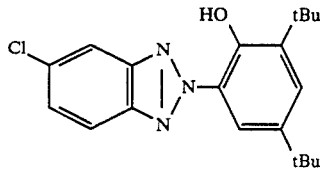

UV-1

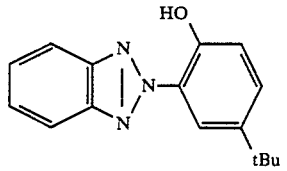

UV-2

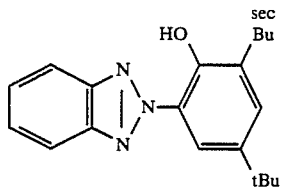

UV-3

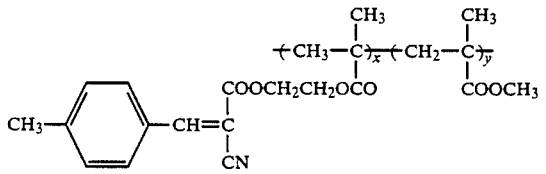

(x/y = 7/3 (wt. ratio))

UV-4

-continued
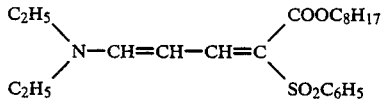
UV-5
Tricresyl Phosphate — Solv-1
Dibutyl Phthalate — Solv-2
Solv-3
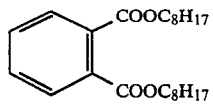
Solv-4
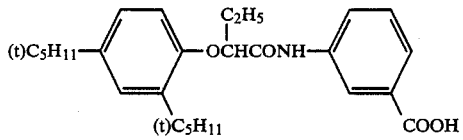
Cpd-1
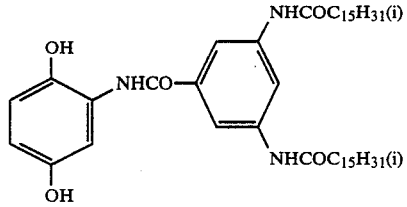
Cpd-2
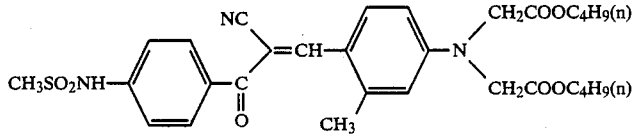
Cpd-3
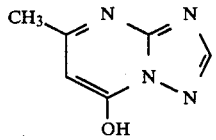
Cpd-4
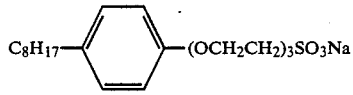
Cpd-5
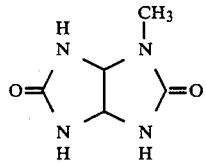
Cpd-6
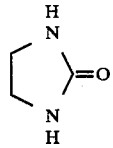
ExC-1
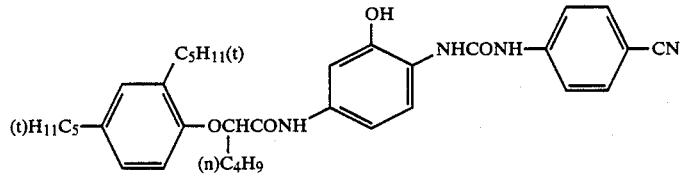

-continued
ExC-2
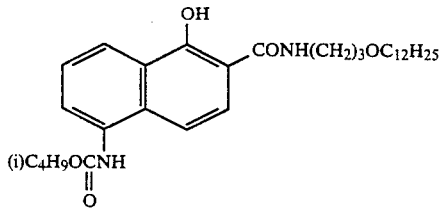
ExC-3
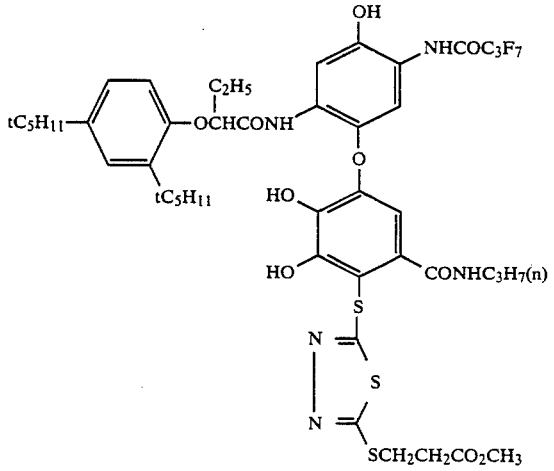
ExC-4
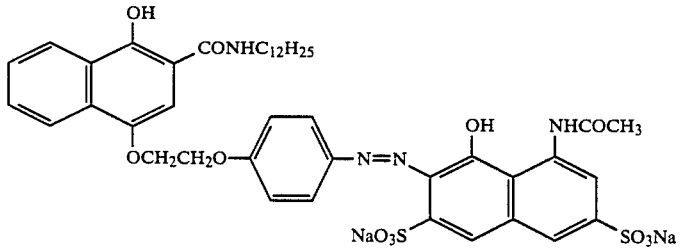
ExC-5
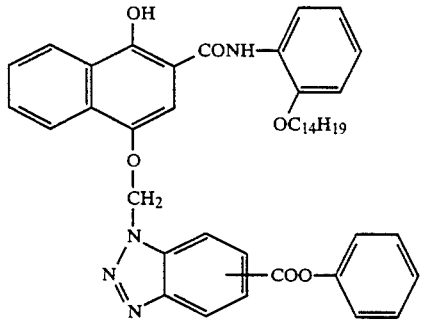
ExC-6
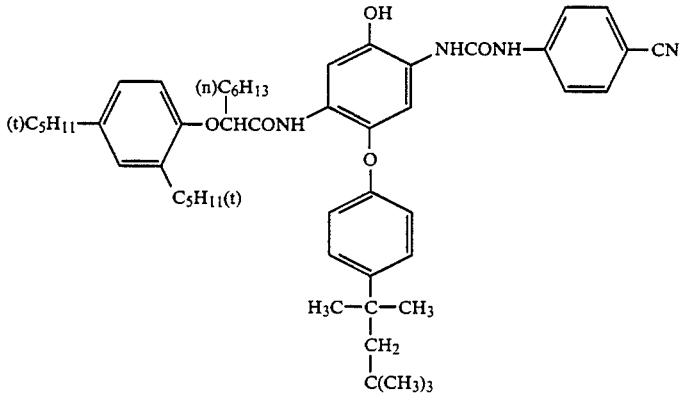

-continued
ExC-7
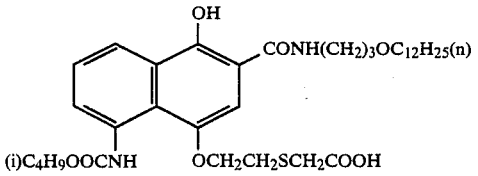
ExC-8
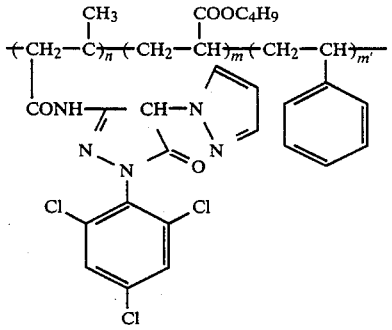
n = 50
m = 25
m' = 25
Mw = about 20,000
ExC-9
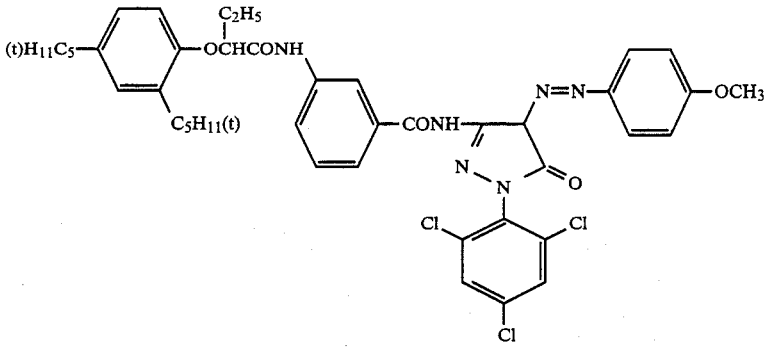
ExC-10
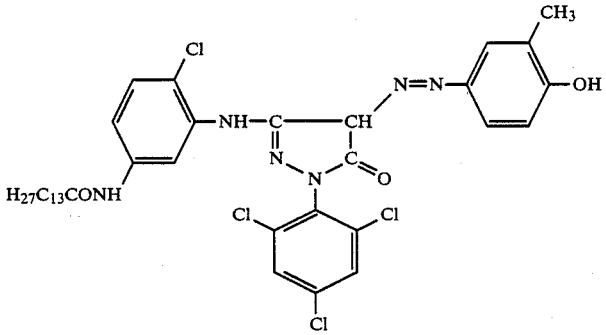
ExC-11
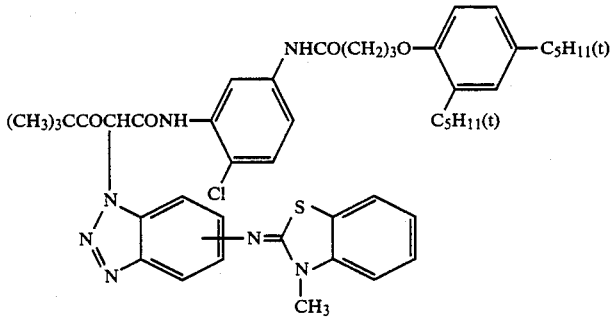

-continued
ExM-12
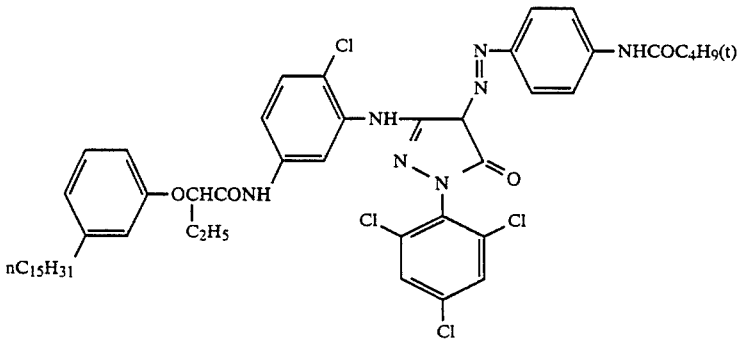
ExY-13
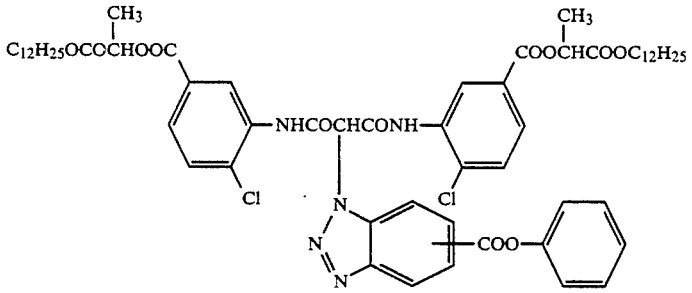
ExY-14
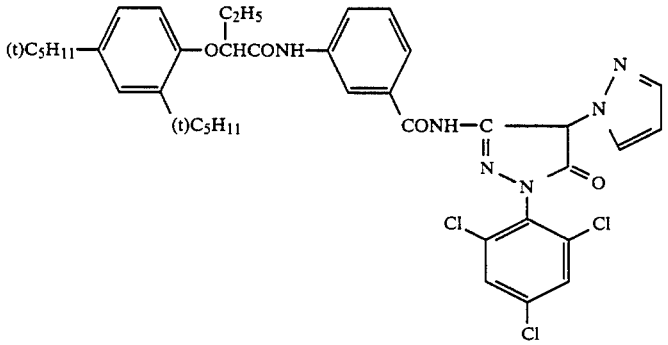
ExY-15
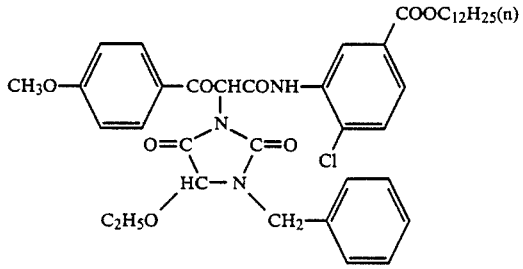

-continued
ExC-16
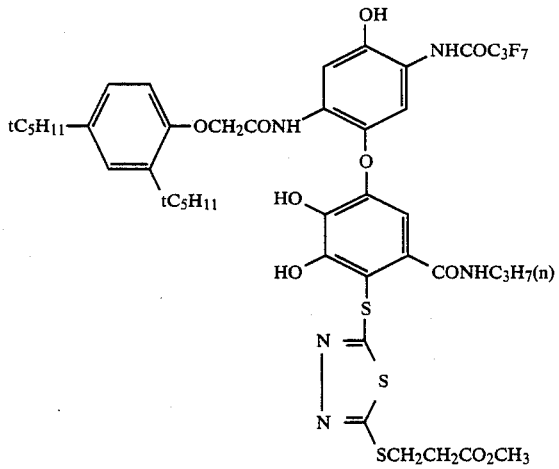
ExS-1
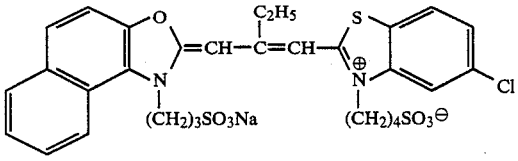
ExS-2
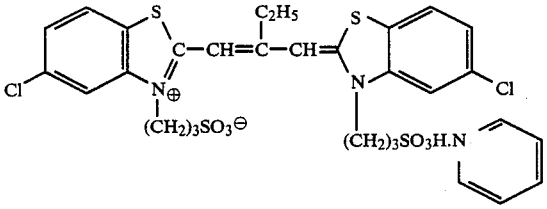
ExS-3
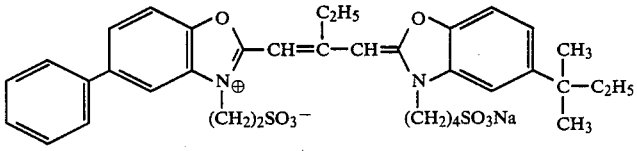
ExS-4
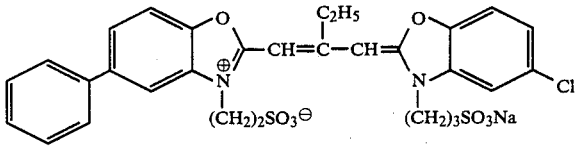
ExS-5
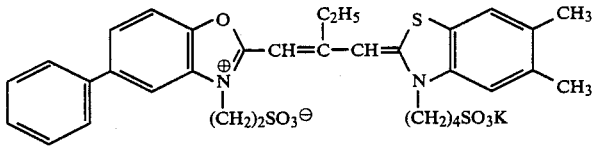
ExS-6
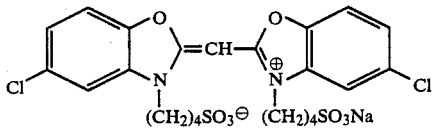
H-1
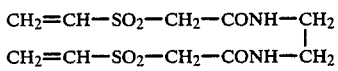

-continued

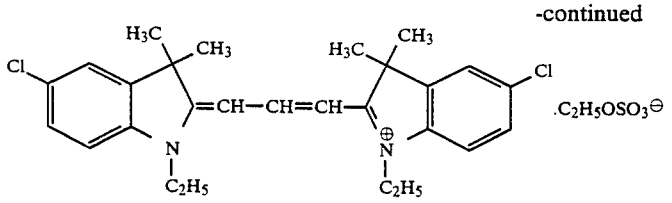

ExF-1

,

| Preparation of Sample 102 | |
|---|---|
| 1st Layer: Halation Inhibiting Layer | |
| Black colloidal silver | 0.18 (Ag) |
| Gelatin | 0.40 |
| 2nd Layer: Intermediate Layer | |
| 2,5-Di-t-pentadecyl hydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| 3rd Layer: First Red-sensitive Emulsion Layer | |
| Monodisperse silver iodobromide emulsion (AgI = 6 mole %; average grain size = 0.6μ; variation coefficient with respect to grain size = 0.15) | 0.55 (Ag) |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| Sensitizing dye IV | $4.0 \times 10^{-5}$ |
| EX-2 | 0.350 |
| HBS-1 | 0.005 |
| EX-10 | 0.020 |
| Gelatin | 1.20 |
| 4th Layer: Second Red-sensitive Emulsion Layer | |
| Tabular silver iodobromide emulsion (AgI = 10 mole %; average grain size = 0.7μ; average aspect ratio = 5.5; average thickness = 0.2μ) | 1.0 (Ag) |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| Sensitizing dye IV | $3.0 \times 10^{-5}$ |
| EX-2 | 0.400 |
| EX-3 | 0.050 |
| EX-10 | 0.015 |
| Gelatin | 1.30 |
| 5th Layer: Third Red-sensitive Emulsion Layer | |
| Silver iodobromide emulsion (AgI = 16 mole %; average grain size = 1.1μ) | 1.60 (Ag) |
| Sensitizing dye IX | $5.4 \times 10^{-5}$ |
| Sensitizing dye II | $1.4 \times 10^{-5}$ |
| Sensitizing dye III | $2.4 \times 10^{-4}$ |
| Sensitizing dye IV | $3.1 \times 10^{-5}$ |
| EX-3 | 0.240 |
| EX-4 | 0.120 |
| HBS-1 | 0.22 |
| HBS-2 | 0.10 |
| Gelatin | 1.63 |
| 6th Layer: Intermediate Layer | |
| EX-5 | 0.040 |
| HBS-1 | 0.020 |
| EX-12 | 0.004 |
| Gelatin | 0.80 |
| 7th Layer: First Green-sensitive Emulsion Layer | |
| Tabular silver iodobromide emulsion (AgI = 6 mole %; average grain size = 0.6μ; average aspect ratio = 6.0; average thickness = 0.15μ) | 0.40 (Ag) |
| Sensitizing dye V | $3.0 \times 10^{-5}$ |
| Sensitizing dye VI | $1.0 \times 10^{-4}$ |
| Sensitizing dye VII | $3.8 \times 10^{-4}$ |
| EX-6 | 0.260 |
| EX-1 | 0.021 |
| EX-7 | 0.030 |

, -continued

| Preparation of Sample 102 | |
|---|---|
| EX-8 | 0.025 |
| HBS-1 | 0.100 |
| HBS-4 | 0.010 |
| Gelatin | 0.75 |
| 8th Layer: Second Green-sensitive Emulsion Layer | |
| Monodisperse silver iodobromide emulsion (AgI = 9 mole %; average grain size = 0.7μ; variation coefficient with respect to grain size = 0.18) | 0.80 (Ag) |
| Sensitizing dye V | $2.1 \times 10^{-5}$ |
| Sensitizing dye VI | $7.0 \times 10^{-5}$ |
| Sensitizing dye VII | $2.6 \times 10^{-4}$ |
| EX-6 | 0.180 |
| EX-8 | 0.010 |
| EX-1 | 0.008 |
| EX-7 | 0.012 |
| HBS-1 | 0.160 |
| HBS-4 | 0.008 |
| Gelatin | 1.10 |
| 9th Layer: Third Green-sensitive Emulsion Layer | |
| Silver iodobromide emulsion (AgI = 12 mole %; average grain size = 1.0μ) | 1.2 (Ag) |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| EX-6 | 0.065 |
| EX-11 | 0.030 |
| EX-1 | 0.025 |
| HBS-1 | 0.25 |
| HBS-2 | 0.10 |
| Gelatin | 1.74 |
| 10th Layer: Yellow Filter Layer | |
| Yellow colloidal silver | 0.05 (Ag) |
| EX-5 | 0.08 |
| HBS-3 | 0.03 |
| Gelatin | 0.95 |
| 11th Layer: First Blue-sensitive Emulsion Layer | |
| Tabular silver iodobromide emulsion (AgI = 6 mole %; average grain size = 0.6μ; average aspect ratio = 5.7; average thickness = 0.15μ) | 0.24 (Ag) |
| Sensitizing dye VIII | $3.5 \times 10^{-4}$ |
| EX-9 | 0.85 |
| EX-8 | 0.12 |
| HBS-1 | 0.28 |
| Gelatin | 1.28 |
| 12th Layer: Second Blue-sensitive Emulsion Layer | |
| Monodisperse silver iodobromide emulsion (AgI = 10 mole %; average grain size = 0.8μ; variation coefficient with respect to grain size = 0.16) | 0.45 (Ag) |
| Sensitizing dye VIII | $2.1 \times 10^{-4}$ |
| EX-9 | 0.20 |
| EX-10 | 0.015 |
| HBS-1 | 0.03 |
| Gelatin | 0.46 |
| 13th Layer: Third Blue-sensitive Emulsion Layer | |
| Silver iodobromide emulsion (AgI = 14 mole %; average grain size = 1.3μ) | 0.77 (Ag) |
| Sensitizing dye VIII | $2.2 \times 10^{-4}$ |
| EX-9 | 0.20 |
| HBS-1 | 0.07 |
| Gelatin | 0.69 |
| 14th Layer: First Protective Layer | |
| Silver iodobromide emulsion (AgI = 1 mole %; average grain size = 0.07μ) | 0.5 (Ag) |
| U-4 | 0.11 |
| U-5 | 0.17 |

, -continued

| Preparation of Sample 102 | |
|---|---|
| HBS-1 | 0.90 |
| Gelatin | 1.00 |
| 15th Layer: Second Protective Layer | |
| Polymethyl acrylate particles (diameter = about 1.5μ) | 0.54 |
| S-1 | 0.15 |
| S-2 | 0.05 |

, -continued

| Preparation of Sample 102 | |
|---|---|
| Gelatin | 0.72 |

In addition to the foregoing components, a gelatin hardening agent, H-1, and a surfactant were added to each layer. Structural formulas and chemical names of the compounds used to prepare Sample 102 are as follows:

U-1

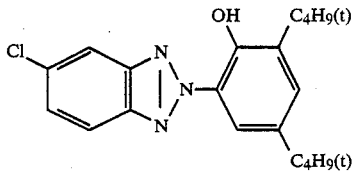

U-2

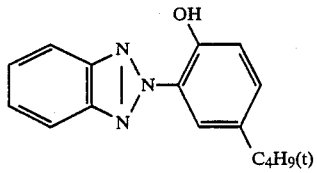

U-3

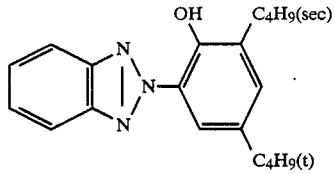

U-4

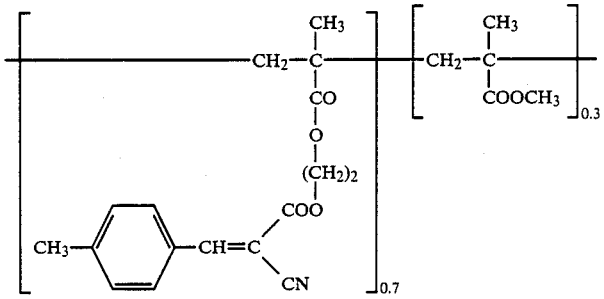

U-5

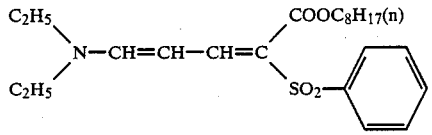

EX-1

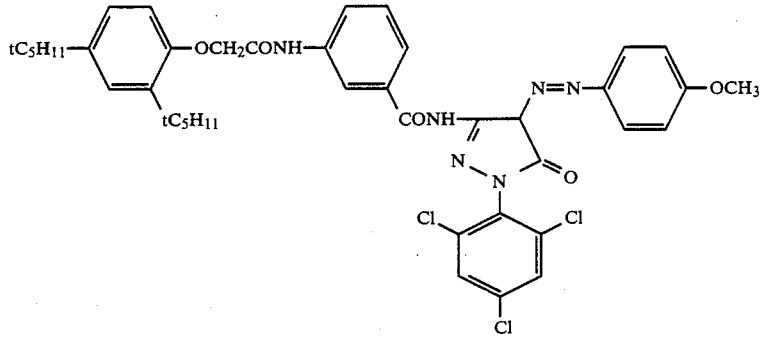

-continued
EX-2
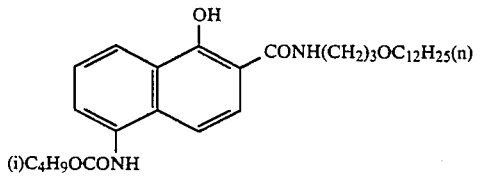
EX-3
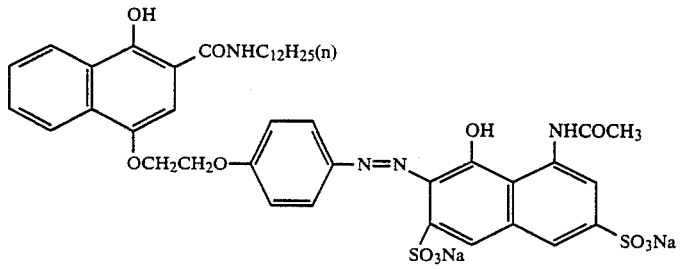
EX-4
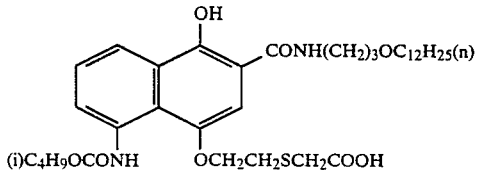
EX-5
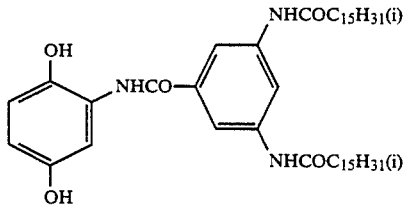
EX-6
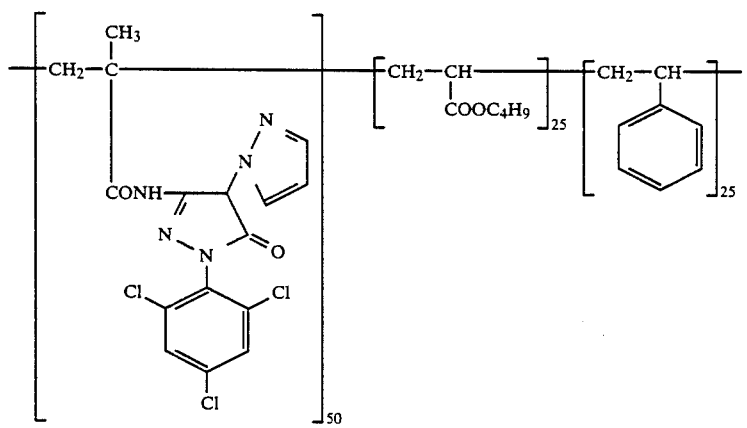
average molecular weight = 30,000
EX-7
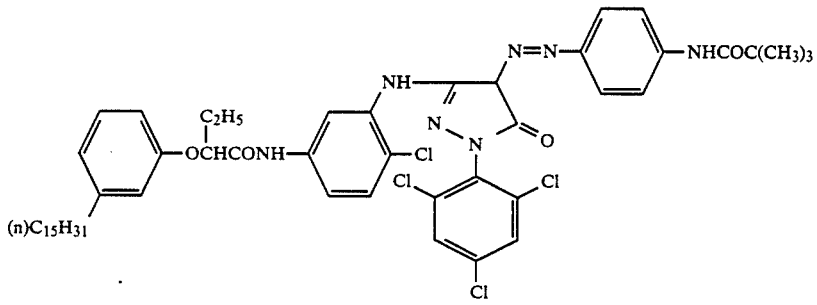

-continued
EX-8
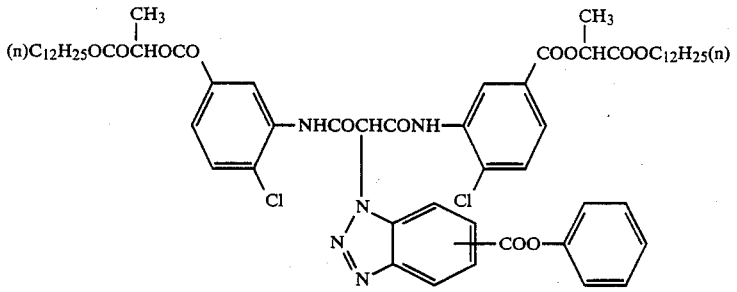
EX-9
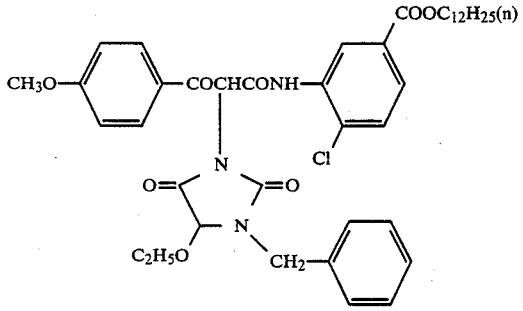
EX-10
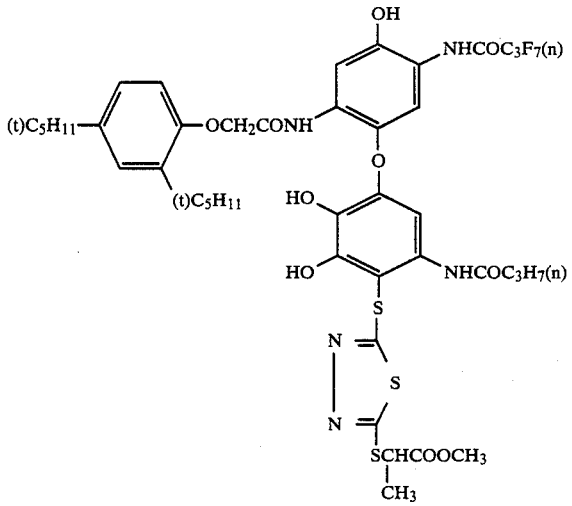
EX-11
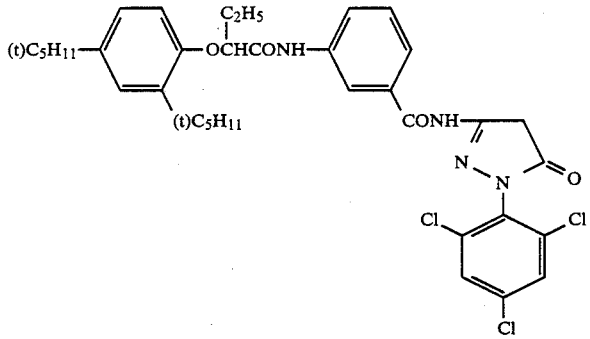
EX-12
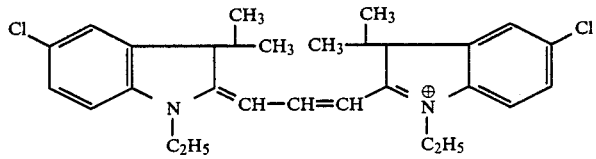

-continued
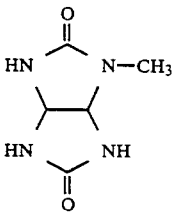
S-1
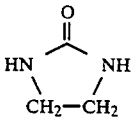
S-2
Tricresyl Phosphate; HBS-1
Dibutyl Phthalate; HBS-2
Bis(2-ethylhexyl) Phthalate HBS-3
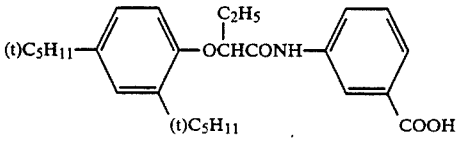
HBS-4
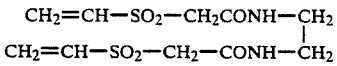
H-1
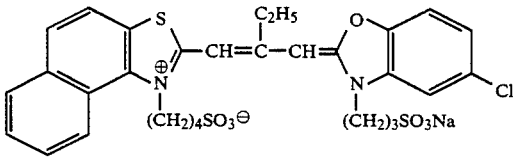
Sensitizing Dye I
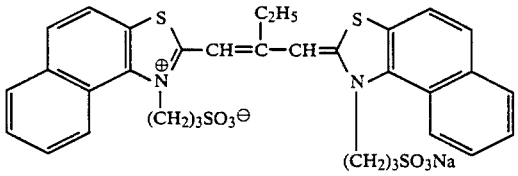
Sensitizing Dye II
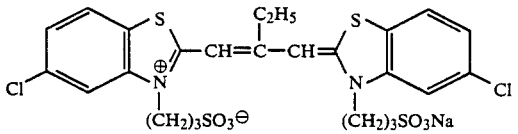
Sensitizing Dye III
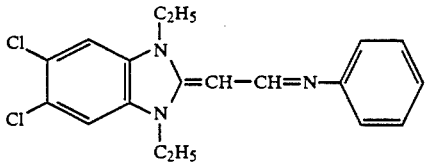
Sensitizing Dye IV
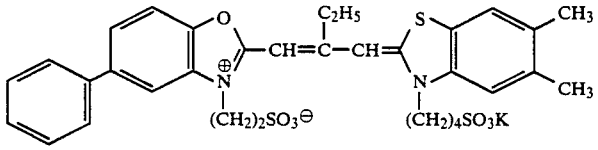
Sensitizing Dye V -continued

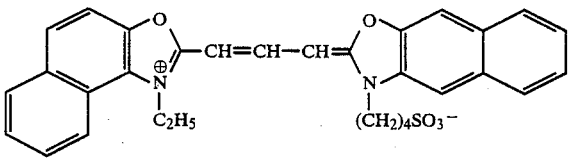

Sensitizing Dye VI

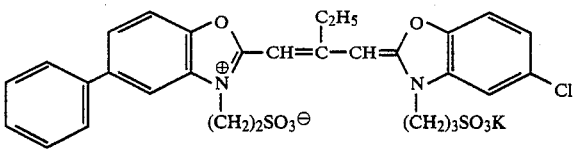

Sensitizing Dye VII

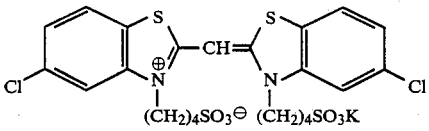

Sensitizing Dye VIII

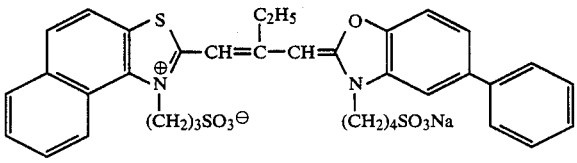

Sensitizing Dye IX

Samples 101 and 102 thus prepared were cut into band-like pieces of 35 mm wide, then were subjected to standard exposure to light corresponding to ISO 100 and 400 were processed according to the following running treatment. In each running treatment, Samples 101 and 102 were processed in a rate of 50 m/day for 10 days (1000 m in all), utilizing an automatic developing machine.

The processing steps and the compositions of the processing solutions used are as follows:

| (Processing Steps) | | | | |
|---|---|---|---|---|
| Process | Time (sec.) | Temp. (°C.) | Tank Vol. (l) | Amount Replenished* ml) |
| Color Development | 195 | 38 | 8 | 400 |
| Bleach-fixing | 180 | 38 | 8 | 400 |
| Water Washing (1) | 40 | 35 | 4 | countercurrent flow |
| Water Washing (2) | 40 | 35 | 4 | system from water washing (2) to (1) 400 |
| Stabilization | 40 | 35 | 4 | 400 |
| Drying | 60 | 60 | — | — |

*The amount replenished is expressed in the amount per 1 $m^2$ of the light-sensitive material processed.

In the processing, the amount of processing solution carried over from each processing bath by the processed light-sensitive material was 70 ml per 1 $m^2$ of the material.

The composition of each processing solution is as follows:

| Component | Tank Soln. (g) | Replenisher (g) |
|---|---|---|
| (Color Developer) | | |
| Diethylenetriaminepentaacetic acid | 1.0 | 1.1 |
| 1-Hydroxyethylidene-1,1-diphosphonic acid | 3.0 | 3.2 |
| Sodium sulfite | 4.0 | 4.9 |

-continued

| Component | Tank Soln. (g) | Replenisher (g) |
|---|---|---|
| Potassium carbonate | 30.0 | 30.0 |
| Potassium bromide | 1.4 | — |
| Potassium iodide | 1.5 (mg) | — |
| Hydroxylamine sulfate | 2.4 | 3.6 |
| 4-(N-Ethyl-N-β-hydroxyethylamino)-2-methylaniline sulfate | 4.5 | 7.2 |
| Water | a.d. 1 l | a.d. 1 l |
| pH | 10.05 | 10.10 |
| (Bleach-fixing Solution) | | |
| Ammonium thiosulfate (70% w/v) | 240 (ml) | 260 (ml) |
| Sodium sulfite | 18 | 20 |
| Ferric ammonium ethylenediaminetetraacetate dihydrate | 90 | 100 |
| Disodium ethylenediaminetetraacetate dihydrate | 9.0 | 10.0 |
| Compound to be added | (see Table I given below) | |
| Water | a.d. 1 l | a.d. 1 l |
| pH | 6.5 | 6.0 |

(Washing Water: Tank Soln. and Replenisher)

Washing water was prepared by passing tap water through a mixed bed column packed with H-type strong acidic cation exchange resin (available from Rohm & Haas Co., Ltd. under the trade name of Amberlite IR-120B) and OH-type anion exchange resin (Amberlite IR-400 available from the same company) to reduce the amount of calcium and magnesium ions to not more than 3 mg/l respectively and then adding 20 mg/l of sodium dichloro isocyanurate and 0.15 g/l of sodium sulfate. The pH velue of this solution was in the range of from 6.5 to 7.5.

| (Stabilization Solution) | | |
|---|---|---|
| Component | Tank Soln. (g) | Replenisher (g) |
| Formalin (37%) | 2.0 (ml) | 3.0 (ml) |
| Polyoxyethylene p-monononylphenyl ether (average degree of polymerization = 10) | 0.3 | 0.45 |
| Disodium ethylenediaminetetraacetate | 0.05 | 0.08 |
| Water | a.d. 1 l | a.d. 1 l |
| pH | 5.0~8.0 | 5.0~8.0 |

After the completion of each running treatment, desilvering test was carried out. The desilvering test was performed by subjecting Samples 101 and 102 to exposure to light corresponding to 20 CMS and 5 CMS at a color temperature of 4800° K., then carrying out each processing and determining the residual amount of silver in each Sample according to fluorescent X-ray analysis. The results obtained are summarized in Table I given below.

TABLE I

| Processings No. | Added Compound & Amount Thereof* BA**(g/l) | Polymer(solid(g)/l) | Amount of residual Ag (μg/cm²) Samp. 101 | Samp. 102 |
|---|---|---|---|---|
| 1# | — | — | 36.5 | 45.2 |
| 2# | — | Ion exchange resin (C)*** (10) | 32.3 | 38.5 |
| 3 | — | Latex polymer 1 (10) | 27.2 | 33.1 |
| 4 | — | Latex polymer 4 (10) | 25.1 | 31.3 |
| 5# | (A) (1.0) | — | 30.2 | 40.8 |
| 6# | " | Ion exchange resin (C) (10) | 11.3 | 15.6 |
| 7 | " | Latex polymer 1 (10) | 4.1 | 5.9 |
| 8 | " | Latex polymer 4 (10) | 2.8 | 3.9 |
| 9 | " | Latex polymer 5 (10) | 2.4 | 3.1 |
| 10 | " | Latex polymer 15 (10) | 3.6 | 4.4 |
| 11 | " | Water-soluble polymer 30 (10) | 3.9 | 4.8 |
| 12# | (B) (1.0) | — | 32.0 | 41.6 |
| 13 | " | Latex polymer 1 (10) | 4.2 | 5.3 |
| 14 | " | Latex polymer 10 (10) | 3.9 | 5.0 |
| 15 | " | Latex polymer 19 (10) | 2.9 | 3.2 |
| 16 | " | Latex polymer 34 (10) | 4.6 | 5.8 |

BA: Bleaching accelerator.
*The amount of the compound added to the tank solution and that added to the replenisher are identical to one another.
**Bleaching accelerators used are as follows:

(A)

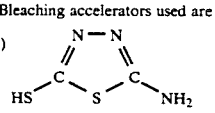

(B)

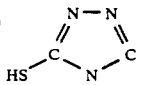

***Ion exchange resin used is as follows:

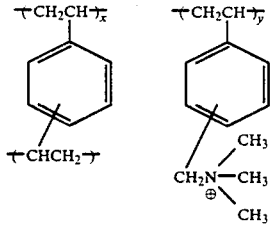

$Cl^{\ominus}$ x:y = 10:90

#This means Comparative Example. This resin is in the form of gel sphere particles having an average particle size of 0.5 mm (range of 0.25 to 0.75 mm).

In Table I, an average particle size of the latex polymers is as follows:

| Latex polymer No. | Average particle size (μ) |
|---|---|
| 1 | 0.10 |
| 4 | 0.08 |
| 5 | 0.10 |
| 10 | 0.12 |
| 15 | 0.10 |
| 19 | 0.10 |
| 34 | 0.15 |

As seen from the above, the desilvering process can be made rapid by adding the compounds of the present invention to the bleach-fixing solution. Particularly, such an effect becomes remarkable when a bleachng accelerator is used. In addition, the compounds of the present invention show such an effect superior to that attained by using well known ion exchange resins.

Alternatively, in the processing Nos. 4 and 10, 150 g each of latex-like compounds (4) and (10) were packed in a cellulose tube for dialysis C-65 (available from SANKO JUNYAKU CO., LTD.) and introduced into a tank for the bleach-fixing solution instead of adding the latex-like compounds (4) and (10) to the processing solution. In such a condition, the same running treatment and the desilvering test as those explained above were performed while supplementing a replenisher for bleach-fixing solution free of such a polymer and it was found that the same results as those observed above were obtained.

EXAMPLE 2

The same running processings as in Example 1 were repeated except that in the processing Nos. 5 (in which no polymer was added) and 8 (in which a latex polymer was added), the amount of the replenisher for the bleach-fixing solution was changed to those shown in the attached FIG. 2. Regarding the desilvering test, the processing was performed using Sample 102 which had been subjected to exposure of 5 CMS at a color temperature of 4800° K. (exposed Sample: E.S.) and Sample 102 which was not exposed to light (unexposed Sample: U.S.) and the amount of silver remaining on the light-sensitive material processed observed after the processing was determined by fluorescent X-ray analysis.

TABLE II

| Processing No. | Bleach-fixing Added Compound* (amount:g/l) | Solution Replenished amount** (ml) | Residual Amount of Ag (μg/cm²) E.S. | U.S. |
|---|---|---|---|---|
| 17# | bleaching accele- | 2000 | 5.3 | 2.8 |
| 18# | rator (A) (1.0) | 800 | 21.2 | 10.5 |
| 19# | (the same as pro- | 400 | 40.8 | 19.8 |
| 20# | cessing No. (5) | 150 | 51.1 | 25.2 |
| 21# | | 50 | 79.6 | 50.9 |
| 22 | bleaching accelerator | 2000 | 3.5 | 2.5 |
| 23 | (A) (1.0); latex poly- | 800 | 3.8 | 2.6 |
| 24 | mer (4) (10) (solid) | 400 | 3.9 | 3.1 |
| 25 | (the same as pro- | 150 | 4.5 | 3.2 |
| 26 | cessing No. 8) | 50 | 15.0 | 10.9 |

*Both the tank soln. and the replenisher;
**The amount per 1 m² of the light-sensitive material processed.
#Comparative Example.

As seen from the results listed in Table II, when the polymer of the present invention is added to the bleach-fixing solution, good desilvering is attained so far as the amount of replenisher for the bleach-fixing solution is not less than 150 ml per 1 m² of the light-sensitive material, while, if the amount replenished is reduced to 50 ml, the amount of residual silver is slightly increased and the desilvering process is delayed. On the contrary, when the polymer is not added to the bleach-fixing solution (Comparative Example), the processed light-sensitive material is almost desilvered at the replenished amount of 2000 ml, but the desilvering process is extremely delayed at a replenished amount of not more than 800 ml. The delay of the desilvering process is also observed on the unexposed Sample. It is thus assumed that the delay of fixing is possibly occured.

Consequently, rapid bleach-fixing treatment can be carried out without increasing the amount of the replenisher if a polymer of this invention is used.

EXAMPLE 3

The following running processings were performed using Samples 101 and 102 prepared in Example 1. In this Example, the amount of light-sensitive material processed was the same as that in Example 1.

| | Processing Steps | | | |
|---|---|---|---|---|
| Process | Time (sec.) | Temp. (°C.) | Amount replenished* (ml) | Tank Vol. (l) |
| Color Development | 195 | 37.8 | 400 | 10 |
| Bleaching | 180 | 37.8 | 140 | 10 |
| Fixing | 180 | 37.8 | 400 | 10 |
| Stabilization (1) | 45 | 35.0 | countercurrent | 5 |
| Stabiliation (2) | 45 | 35.0 | flow system from | 5 |
| Stabilization (3) | 45 | 35.0 | (3) to (1) 400 | 5 |
| Drying | 80 | 55.0 | — | — |

*The amount replenished is expressed in the amount per 1 $m^2$ of the light-sensitive material processed.

The composition of each processing solution will be detailed below.

| (Color Developer): The same as that used in Example 1. | | |
|---|---|---|
| Component | Tank Soln. (g) | Replenisher(g) |
| (Bleaching Solution) | | |
| Ferric ammonium ethylenediaminetetraacetate dihydrate | 70.0 | 120.0 |
| Ferric 1,3-diaminopropanetetraacetate | 35.0 | 55.0 |
| Ethylenediaminetetraacetic acid | 4.0 | 5.0 |
| Ammonium bromide | 100.0 | 160.0 |
| Ammonium nitrate | 30.0 | 50.0 |
| 27% Aqueous ammonia | 20.0 (ml) | 23.0 (ml) |
| 98% Acetic acid | 9.0 (ml) | 15.0 (ml) |
| Water | a.d. 1.0 l | a.d. 1.0 l |
| pH | 5.5 | 4.5 |
| (Fixing Solution) | | |
| Disodium ethylenediaminetetraacetate | 0.5 | 0.7 |
| Sodium sulfite | 7.0 | 8.0 |
| Sodium bisulfite | 5.0 | 5.5 |
| Aqueous solution of ammonium thiosulfate | 170.0 (ml) | 200.0 (ml) |
| Added compound | (see TABLE III) | |
| Water | a.d. 1.0 l | a.d. 1.0 l |
| pH | 6.7 | 6.6 |

| (Stabilization Solution): Tank Soln. and Replenisher | |
|---|---|
| Component | Amount (g) |
| Formalin (37%) | 1.2 (ml) |
| 5-Chloro-2-methyl-4-isothiazolin-3-one | 6.0 (mg) |
| 2-Methyl-4-isothiazolin-3-one | 3.0 (mg) |
| Surfactant $[C_{10}H_{21}—O(CH_2CH_2O)_{10}—H]$ | 0.4 |
| Ethylene glycol | 1.0 |
| Water | a.d. 1.0 l |
| pH | 5.7 ~ 7.05 |

After the running treatment, desilvering test was performed using exposed and unexposed Sample 102 as in Example 2. The results observed are summarized in the following Table III.

TABLE III

| Processing No. | Added Compound* Polymer used | Amount Added (solid;g/l) | Residual Amount of Ag ($\mu g/cm^2$) E.S. | U.S. |
|---|---|---|---|---|
| 27# | — | — | 13.3 | 18.0 |
| 28 | Latex Polymer (4) | 10 | 3.4 | 3.2 |
| 29 | Latex Polymer (5) | 10 | 2.4 | 2.3 |
| 30 | Latex Polymer (15) | 10 | 4.2 | 4.5 |
| 31 | Water-soluble Polymer (30) | 10 | 6.3 | 6.5 |

*Both the tank soln. and the replenisher.
#Comparative Example.

As seen from Table III, when the amount of the fixing solution replenised is low (in this Example, 400 ml per 1 $m^2$ of the processed light-sensitive material), there was observed delay of desilvering which was thought to take place due to the delay of the fixing, but sufficient desilvering could be achieved through the addition of the compound of this invention.

Therefore, a rapid processing can likewise be attained while saving the amount of the replenisher when the compound of the invention is added to the fixing solution.

EXAMPLE 4

In accordance with the following processing steps, the running treatment and the desilvering test similar to those in Example 3 were carried out and the same effect as before could be achieved in this Example.

| | Processing Steps | | | |
|---|---|---|---|---|
| Process | Time (sec.) | Temp. (°C.) | Amount replenished* (ml) | Tank Vol. (l) |
| Color Development | 195 | 38.0 | 400 | 10 |
| Bleaching | 60 | 38.0 | 200** | 4 |
| Bleach-fixing | 195 | 38.0 | 200 | 10 |
| Water washing (1) | 40 | 35.0 | countercurrent | 4 |
| Water washing (2) | 60 | 35.0 | flow system from (2) to (1) 400 | 4 |
| Stabilization | 40 | 38.0 | 530 | 4 |
| Drying | 80 | 60 | — | — |

*The amount replenished is expressed in the amount per 1 $m^2$ of the light-sensitive material processed.
**The overflow from the bleaching process was introduced into the bleach-fixing process.

The composition of each processing solution will be detailed below.

(Color Developer)
(Water Washing Solution) The same as those used in Example 1.
(Stabilization Solution)

| (Bleaching Solution): Tank Soln. & Replenisher | |
|---|---|
| Component | Amount Added (g) |
| Ferric ammonium ethylenediaminetetraacetate dihyrate | 180.0 |
| Disodium ethylenediaminetetraacetate | 10.0 |
| Ammonium bromide | 200.0 |
| Ammonium nitrate | 10.0 |
| Bleaching accelerator | 2.0 |

-continued

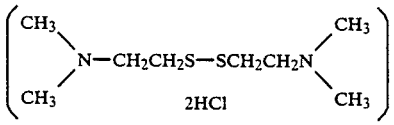

| | |
|---|---|
| 27% Aqueous ammonia | 15.0 (ml) |
| Water | a.d. 1.0 l |
| pH | 5.5 |

(Bleach-fixing Solution)

| Component | Tank Soln.(g) | Replenisher(g) |
|---|---|---|
| Ferric ammonium ethylenediaminetetraacetate dihydrate | 50.0 | — |
| Disodium ethylenediaminetetraacetate | 5.0 | — |
| Sodium sulfite | 12.0 | 25.0 |
| 70% Aqueous solution of ammonium thiosulfate | 240.0 (ml) | 500.0 (ml) |
| 27% aqueous ammonia | 6.0 (ml) | — |
| Added compound | (see Example 3) | |
| Water | a.d. 1.0 l | a.d. 1.0 l |
| pH | 7.2 | 8.2 |

EXAMPLE 5

A color reversal light-sensitive material (Sample 103) having the following construction was subjected to the running treatment using the following processing steps and processing solutions and then desilvering test was performed as in Example 3. Likewise, the same effect was achieved. In this Example, Sample which had been cut into band-like pieces of 35 mm wide and subjected to standard exposure of ISO 100 (daylight) was processed in this running treatment in a rate of 100 m/day for 10 days.

Construction of Sample 103

Following layers are applied in order onto the surface of a substrate of cellulose triacetate.

1st layer: Halation Inhibiting layer
2nd layer: Intermediate layer-1
3rd layer: Intermediate layer-2
4th layer: 1st Red-sensitive Emulsion layer silver iodobromide emulsion (AgBrI emulsion: AgI 5 mole%)
5th layer: 2nd Red-sensitive Emulsion layer (AgBrI emulsion: AgI 4 mole%)
6th layer: 3rd Red-sensitive Emulsion layer (AgBrI emulsion: AgI 2 mole%)
7th layer: Intermediate layer
8th layer: Intermediate layer
9th layer: 1st Green-sensitive Emulsion layer (AgBrI emulsion: AgI 5mole%)
10th layer: 2nd Green-sensitive Emulsiosn layer (AgBrI emulsion: AgI 5mole%)
11th layer: 3rd Green-sensitive Emulsiosn layer (AgBrI emulsion: AgI 2 mole%)
12th layer: Intermediate layer
13th layer: Yellow-filter layer
14th layer: 1st Blue-sensitive layer (AgBrI emulsion: AgI 3 mole%)
15th layer: 2nd Blue-sensitive layer (AgBrI emulsion: AgI 2 mole%)
16th layer: 3rd Blue-sensitive layer (AgBrI emulsion: AgI 2 mole%)
17th layer: 1st Protective layer
18th layer: 2nd Protective layer

| Process | Time (sec.) | Temp. (°C.) | Amount replenished* (ml) | Tank Vol. (l) |
|---|---|---|---|---|
| First Development | 360 | 38.0 | 2200 | 12 |
| First Water Washing | 120 | 38.0 | 7500 | 4 |
| Reversal | 120 | 38.0 | 1100 | 4 |
| Color Development | 360 | 38.0 | 2200 | 12 |
| Conditioning | 120 | 38.0 | 1100 | 4 |
| Bleaching | 360 | 38.0 | 220 | 12 |
| Fixing | 240 | 38.0 | 400 | 8 |
| Second Water Washing | 240 | 38.0 | 7500 | 8 |
| Stabilization | 60 | 25.0 | 1100 | 2 |
| Drying | 120 | 55 | — | — |

*The amount replenished is expressed in the amount per 1 $m^2$ of the light-sensitive material processed.

The composition of each processing solution will hereunder be detailed:

(First Developer)

| Component | Tank Soln. (g) | Replenisher(g) |
|---|---|---|
| Pentasodium nitrilo-N,N,N-trimethylene phosphonate | 2.0 | 2.0 |
| Sodium sulfite | 30 | 30 |
| Potassium hydroquinone monosulfonate | 20 | 20 |
| Potassium carbonate | 33 | 33 |
| 1-Phenyl-4-methyl-4-hydroxymethyl-3-pyrazolidone | 2.0 | 2.0 |
| Potassium bromide | 2.5 | 1.4 |
| Potassium thiocyanate | 1.2 | 1.2 |
| Potassium iodide | 2.0 (mg) | — |
| Water | a.d. 1.0 l | a.d. 1.0 l |
| pH | 9.60 | 9.60 |

*The pH value was adjusted with hydrochloric acid or potassium hydroxide.

(Reversal Solution): Tank Soln. and Replenisher

| Component | Amount Added (g) |
|---|---|
| Pentasodium nitrilo-N,N,N-trimethylene phosphonate | 3.0 |
| Tin(I) chloride dihydrate | 1.0 |
| p-Aminophenol | 0.1 |
| Sodium hydroxide | 8 |
| Glacial acetic acid | 15 (ml) |
| Water | a.d. 1.0 l |
| pH | 6.00 |

*The pH value was adjusted with hydrochloric acid or sodium hydroxide.

(Color Developer)

| Component | Tank Soln. (g) | Replenisher(g) |
|---|---|---|
| Pentasodium nitrilo-N,N,N-trimethylene phosphonate | 2.0 | 2.0 |
| Sodium sulfite | 7.0 | 7.0 |
| Trisodium phosphate dodecahydrate | 36 | 36 |
| Potassium carbonate | 33 | 33 |
| Potassium bromide | 1.0 | — |
| Potassium iodide | 90 (mg) | — |
| Sodium hydroxide | 3.0 | 3.0 |
| Citrazinic acid | 1.5 | 1.5 |
| N-Ethyl-(β-methanesulfonamidoethyl)-3-methyl-4-aminoaniline sulfate | 11 | 11 |
| 3,6-Dithiaoctane-1,8-diol | 1.0 | 1.0 |
| Water | a.d. 1.0 l | a.d. 1.0 l |
| pH | 11.80 | 12.00 |

*The pH value was adjusted with sulfuric acid or sodium hydroxide.

(Conditioning Solution): Tank Soln. and Replenisher

| Component | Amount Added (g) |
|---|---|
| Disodium ethylenediaminetetraacetate dihydrate | 8.0 |
| Sodium sulfite | 12 |
| 1-Thioglycerin | 0.4 (ml) |
| Water | a.d. 1.0 l |
| pH | 6.20 |

*The pH value was adjusted with hydrochloric acid or sodium hydroxide.

(Bleaching Solution)

| | Tank | Replen- |
|---|---|---|

-continued

| Component | Soln. (g) | isher(g) |
|---|---|---|
| Disodium ethylenediaminetetraacetate dihydrate | 2.0 | 4.0 |
| Ferric ammonium ethylenediaminetetraacetate dihydrate | 120 | 240 |
| Potassium bromide | 100 | 200 |
| Ammonium nitrate | 10 | 20 |
| Water | a.d. 1.0 l | a.d. 1.0 l |
| pH | 5.70 | 5.50 |

*The pH value was adjusted with hydrochloric acid or sodium hydroxide.

(Fixing Solution)

| Component | Tank Soln. (g) | Replenisher(g) |
|---|---|---|
| Ammonium thiosulfate | 80 | 200 |
| Sodium sulfite | 5.0 | 10.0 |
| Sodium bisulfite | 5.0 | 10.0 |
| Added compound | (see Example 3) | |
| Water | a.d. 1.0 l | a.d. 1.0 l |
| pH | 6.60 | 6.80 |

*The pH value was adjusted with hydrochloric acid or aqueous ammonia.

(Water Washing Solution)

(Stabilization Solution) The same as that used in Example 1.

What is claimed is:

1. A method for continuously processing silver halide color photographic light-sensitive materials which comprises the steps of developing an exposed silver halide color photographic light-sensitive material, then desilvering the developed light-sensitive material with a solution having a fixing ability, washing and/or stabilizing the desilvered light-sensitive material, the light-sensitive material being provided thereon with at least one emulsion layer which is formed from a silver halide emulsion containing not less than one mole% of silver iodide and the processing solution having fixing ability comprising at least one member selected from the group consisting of polymer dispersions and water-soluble polymers represented by the following general formula (I):

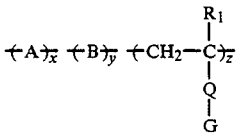

(I)

in formula (I), A represents a copolymerizable monomer unit having at least two copolymerizable ethylenically unsaturated groups, at least one of which is attached to the side chain of the monomer; B represents a copolymerizable ethylenically unsaturated monomer unit other than the monomer unit of A and the monomer unit having the copolymerization ratio of Z; $R_1$ represents a hydrogen atom, a lower alkyl group or an aralkyl group; Q is a single bond, an alkylene group, a phenylene group, an aralkylene group, —CO—O—L—, —CO—NH—L— or —CO—N-R—L— wherein L represents an alkylene, arylene or aralkylene group and R is an alkyl group; G represents a group represented by the following general formula (a) or (b):

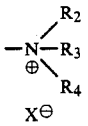

(a)

-continued or

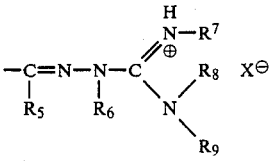

(b)

in formulas (a) and (b), $R_2$ to $R_9$ may be the same or different and each represents a hydrogen atom, an alkyl group, an aryl group or an aralkyl group, which may be substituted; $X^-$ is an anion, provided that at least two of Q, $R_2$, $R_3$ and $R_4$ or at least two of Q and $R_5$ to $R_9$ may be bonded together to form a ring structure together with the nitrogen atom(s); and x, y and z represent molar percentages of the corresponding repeating units respectively, x being 0 to 60, y being 0 to 60 and z being 30 to 100.

2. A method according to claim 1 wherein the processing solution having fixing ability is a fixing solution.

3. A method according to claim 1 wherein the processing solution having fixing ability is a bleach-fixing solution.

4. A method according to claim 1 wherein the polymer dispersions and water-soluble polymers represented by formula (I) are incorporated into the processing solution by directly admixing the polymer in the form of a latex or in the form of a polymer soluble in water with the processing solution.

5. A method according to claim 1 wherein the amount of the polymer dispersions and water-soluble polymers represented by formula (I) ranges from 1 to 50 g per 1 l of the processing solution, based on the solid content.

6. A method according to claim 5 wherein the amount of the polymer dispersions and water-soluble polymers represented by formula (I) ranges from 5 to 30 g per 1 l of the processing solution, based on the solid content.

7. A method according to claim 1 wherein the monomer unit A is selected from the group consisting of divinyl benzene, ethylene glycol dimethacrylate, diethylene glycol dimethacrylate, triethylene glycol dimethacrylate, ethylene glycol diacrylate, diethylene glycol diacrylate, 1,6-hexanediol diacrylate, neopentyl glycol dimethacrylate and tetramethylene glycol dimethacrylate.

8. A method according to claim 1 wherein the monomer unit B is selected from the group consisting of ethylene, propylene, 1-butene, isobutene, styrene, α-methylstyrene, vinyl toluene, vinyl acetate, allyl acetate, methyl methacrylate, ethyl methacrylate, n-butyl methacrylate, n-hexyl methacrylate, cyclohexyl methacrylate, benzyl methacrylate, n-butyl acrylate, n-hexyl acrylate, 2-ethylhexyl acrylate, acrylonitrile, butadiene and isoprene.

9. A method according to claim 1 wherein in formula (I), $R_1$ is a hydrogen atom, a lower alkyl group having 1 to 6 carbon atoms or an aralkyl group; Q is an optionally substituted divalent alkylene group having 1 to 12 carbon atoms, an optionally substituted phenylene group, an optionally substituted aralkylene group having 7 to 12 carbon atoms or a group —CO—O—L—, —CO—NH—L— or —CO—NR—L— wherein L is an optionally substituted alkylene group having 1 to 6 carbon atoms, an optionally substituted arylene group or an optionally substituted aralkylene group having 7 to 12 carbon atoms and R is an alkyl group having 1 to 6 carbon atoms; and G is a group (a) or (b) in which $R_2$ to $R_9$ may be the same or different and each represents a hydrogen atom, a substituted or unsubstituted alkyl group having 1 to 20 carbon atoms, a substituted or unsubstituted aryl group having 6 to 20 carbon atoms or a substituted or unsubstituted aralkyl group having 7 to 20 carbon atoms, provided that at least two of Q and $R_2$ to $R_4$ or at least two of Q and $R_5$ to $R_9$ may be bonded together to form a pyrrolidine, piperidine, morphorin, pyridine, imidazole or quinuclidine ring, together with the nitrogen atom.

10. A method according to claim 9 wherein in formula (I), A is a divinyl benzene or ethylene glycol dimethacrylate unit; B is a styrene, n-butyl methacrylate or cyclohexyl methacrylate unit; $R_1$ is a hydrogen atom or a methyl group; x ranges from 0 to 40 mole%; y ranges from 0 y to 40 mole% and z ranges from 40 to 95 mole%.

11. A method according to claim 1 wherein the polymer dispersions and water-soluble polymers represented by formula (I) is a member selected from the group consisting of those represented by the following general formula (II):

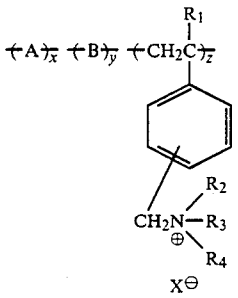

(II)

in formula (II), A, B, x, y, z, $R_1$ to $R_4$ and $X^-$ are the same as those defined above.

12. A method according to claim 11 wherein in formula (II), $R_2$, $R_3$, $R_4$ each represents an alkyl group and the total number of carbon atoms of $R_2$, $R_3$, $R_4$ is not less than 12.

13. A method according to claim 1 wherein the silver halide emulsion contains 5 to 25 mole% of silver iodide.

14. A method according to claim 13 wherein the silver iodide is at least one member selected from the group consisting of silver iodide, silver iodobromide, silver chloroiodobromide and silver chloroiodide.

15. A method according to claim 1 wherein the amount of the processing solution having fixing ability which is replenished is not more than 1,000 ml.

16. A method according to claim 1 wherein the processing solution having fixing ability is a bleach-fixing solution and contains a bleaching accelerator in an amount of $1\times10^{-5}$ to $10^{-1}$ mole per l.

* * * * *